US008405578B2

(12) United States Patent
Kim et al.

(10) Patent No.: US 8,405,578 B2
(45) Date of Patent: Mar. 26, 2013

(54) PLASMA DISPLAY DEVICE AND DRIVING APPARATUS THEREOF

(75) Inventors: Suk-Ki Kim, Yongin-si (KR); Sang-Hun Park, Yongin-si (KR); Kwan-Il Oh, Yongin-si (KR); Sang-Chul Kim, Yongin-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 280 days.

(21) Appl. No.: 12/965,811

(22) Filed: Dec. 10, 2010

(65) Prior Publication Data

US 2012/0044234 A1 Feb. 23, 2012

(30) Foreign Application Priority Data

Aug. 17, 2010 (KR) ..... 10-2010-0079260

(51) Int. Cl.
*G09G 3/28* (2006.01)

(52) U.S. Cl. ..... 345/70

(58) Field of Classification Search ..... 345/60, 345/70

See application file for complete search history.

(56) References Cited

U.S. PATENT DOCUMENTS

| | | | | |
|---|---|---|---|---|
| 6,803,889 | B2 * | 10/2004 | Onozawa et al. | 345/60 |
| 7,304,436 | B2 | 12/2007 | Cho | |
| 7,492,333 | B2 * | 2/2009 | Lee et al. | 345/60 |
| 7,652,642 | B2 * | 1/2010 | Moon | 345/68 |
| 2004/0207619 | A1 | 10/2004 | Cho et al. | |
| 2005/0088376 | A1 | 4/2005 | Inoue | |
| 2005/0116763 | A1 | 6/2005 | Van Der Broeck et al. | |
| 2006/0232506 | A1 | 10/2006 | Jeong | |
| 2009/0039787 | A1 | 2/2009 | Oh | |
| 2010/0149144 | A1 | 6/2010 | Lim et al. | |

FOREIGN PATENT DOCUMENTS

| | | | |
|---|---|---|---|
| EP | 1318593 | A2 | 6/2003 |
| KR | 2003-0044391 | A | 6/2003 |
| KR | 10-2004-0083186 | A | 10/2004 |
| KR | 10-2006-0036797 | | 5/2006 |
| KR | 10-2007-0028842 | | 3/2007 |
| KR | 10-2011-0047467 | A | 5/2011 |

OTHER PUBLICATIONS

New Multi-Output LLC Resonant Converter for High Efficiency and Low Cost PDP Power Model [Chong-Eun Kim et al.] (Jun. 18, 2006), p. 1-7. Cited in European Search Report issued by European Patent Office on May 24, 2011, corresponding to Korean Patent Application No. 10-2010-0079260.

European Search Report issued by European Patent Office on May 24, 2011, corresponding to Korean Patent Application No. 10-2010-0079260 attached herewith.

Korean Office action issued by KIPO on Jul. 20, 2011, corresponding to Korean Patent Application No. 10-2010-0079260 and Request for Entry attached herewith.

(Continued)

*Primary Examiner* — Kevin M Nguyen
(74) *Attorney, Agent, or Firm* — Robert E. Bushnell, Esq.

(57) ABSTRACT

In a plasma display device, a secondary coil of a transformer is connected across a panel capacitor formed by a scan electrode and a sustain electrode performing a sustain discharge. The plasma display device uses resonance between a secondary coil of a transformer and a panel capacitor to apply a sustain discharge pulse to a scan electrode and a sustain electrode in a sustain period.

20 Claims, 19 Drawing Sheets

OTHER PUBLICATIONS

New Multi-Output LLC Resonant Coverter for High Efficiency and Low Cost PDP Power Module[Chong-Eun Kim et al.] (Jun. 18, 2006), p. 1-7. Cited in European Office Action issued by European Patent Office on May 23, 2011. Corresponding to KR 10-2010-0079260.

European Office Action issued by European Patent Office on May 23, 2011. Corresponding to KR 10-2010-0079260.

* cited by examiner

PLASMA DISPLAY DEVICE AND DRIVING APPARATUS THEREOF

CLAIM OF PRIORITY

This application makes reference to, incorporates the same herein, and claims all benefits accruing under 35 U.S.C. §119 from an application earlier filed in the Korean Intellectual Property Office on 17 Aug. 2010 and there duly assigned Serial No. 10-2010-0079260.

BACKGROUND OF THE INVENTION

1. Field of the Invention

The present invention relates to a plasma display device and a driving apparatus thereof, and more specifically, to a plasma display device and a driving apparatus thereof employing less number of circuit devices.

2. Description of the Related Art

A plasma display device applies a sustain discharge pulse alternately having a high level voltage and a low level voltage to a display electrode that performs sustain discharge for sustain discharge of a light emitting cell. Since a capacitive component (hereinafter, referred to as "panel capacitor") is formed by two display electrodes generating the sustain discharge, reactive power is generated when a high level voltage and a low level voltage are alternately applied to the display electrode. The plasma display device uses an energy recovery circuit that recovers the reactive power and reuses it.

The energy recovery circuit generates resonance between an inductor electrically connected between a panel capacitor and an energy recovery capacitor and the panel capacitor, recovers resonant current discharged from the panel capacitor to the energy recovery capacitor, supplies the resonant current for charging the panel capacitor from the energy recovery capacitor.

Therefore, in the plasma display device, a driver driving a scan electrode for sustain discharge of the light emitting cell and a driver driving the sustain electrode are each formed with the energy recovery circuit having the same structure.

As described above, the driver driving the scan electrode and the driver driving the sustain electrode are each formed with the energy recovery circuit having the same structure, such that a large number of circuit devices are used in the plasma display device, thereby increasing the cost of the plasma display device.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a plasma display device and a driving apparatus thereof having advantages of reducing the number of used circuit devices.

An embodiment of the present invention provides a plasma display device including a panel capacitor formed by a first electrode and a second electrode performing sustain discharge. The plasma display device includes first through the fourth transistors, a transformer and first and the second diodes. A first transistor is connected between a first power supply supplying first voltage and the first electrode. A second transistor is connected between a second power supply supplying second voltage lower than the first voltage and the first electrode. A third transistor is connected between the first power supply and the second electrode. A fourth transistor is connected between the second power supply and the second electrode. A transformer includes a primary coil whose first terminal is connected to an input power supply and second terminal is connected to a ground terminal and a secondary coil whose first terminal is connected to the first electrode and second terminal is connected to the second electrode. The first diode is connected between the second terminal of the secondary coil and the first power supply. The second diode is connected between the second terminal of the secondary coil and the second power supply.

Another embodiment of the present invention provides a plasma display device including a panel capacitor formed by a first electrode and a second electrode performing sustain discharge. The plasma display device includes a first driver, a second driver, and a power supply unit. The first driver applies a sustain discharge pulse alternately having a high level voltage and a low level voltage to the first electrode in a sustain period. The second driver applies the sustain discharge pulse to the second electrode in an anti-phase to the sustain discharge pulse applied to the first electrode in the sustain period. The power supply unit supplies power to the first and second drivers by using a transformer including a primary coil connected between an input power supply and a ground terminal and a secondary coil connected between the first electrode and the second electrode and at least one first transistor operated so that voltage across the primary coil becomes a square wave voltage. In this case, the first and the second drivers use the resonance between the secondary coil and the panel capacitor in the sustain period to apply the sustain discharge pulse.

Yet another embodiment of the present invention provides a driving apparatus of a plasma display panel including a first electrode and a second electrode performing a display operation by receiving DC power using a transformer including a primary coil and a secondary coil. The driving apparatus includes first and second transistors and first and second diodes. The first transistor is connected between a first power supply supplying first voltage and the first electrode. The second transistor is connected between a second power supply supplying second voltage lower than the first voltage and the first electrode. The anode of the first diode is connected to one terminal of the secondary coil and the cathode thereof is connected to the first power supply. The cathode of the second diode is connected to one terminal of the secondary coil and anode thereof is connected to the second power supply. In this case, one terminal of the secondary coil is connected to the second electrode and the other terminal of the secondary coil is connected to the first electrode.

According to the embodiments of the present invention, the driver driving the scan electrode and the driver driving the sustain electrode each use the circuit device of the power supply apparatus to apply the sustain discharge pulse in the sustain period, thereby making it possible to reduce the circuit device used in the plasma display device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 6A through 6J are diagrams showing a current path according the signal timing diagram shown in FIG. 5;

DETAILED DESCRIPTION OF THE EMBODIMENTS

Figure 1:
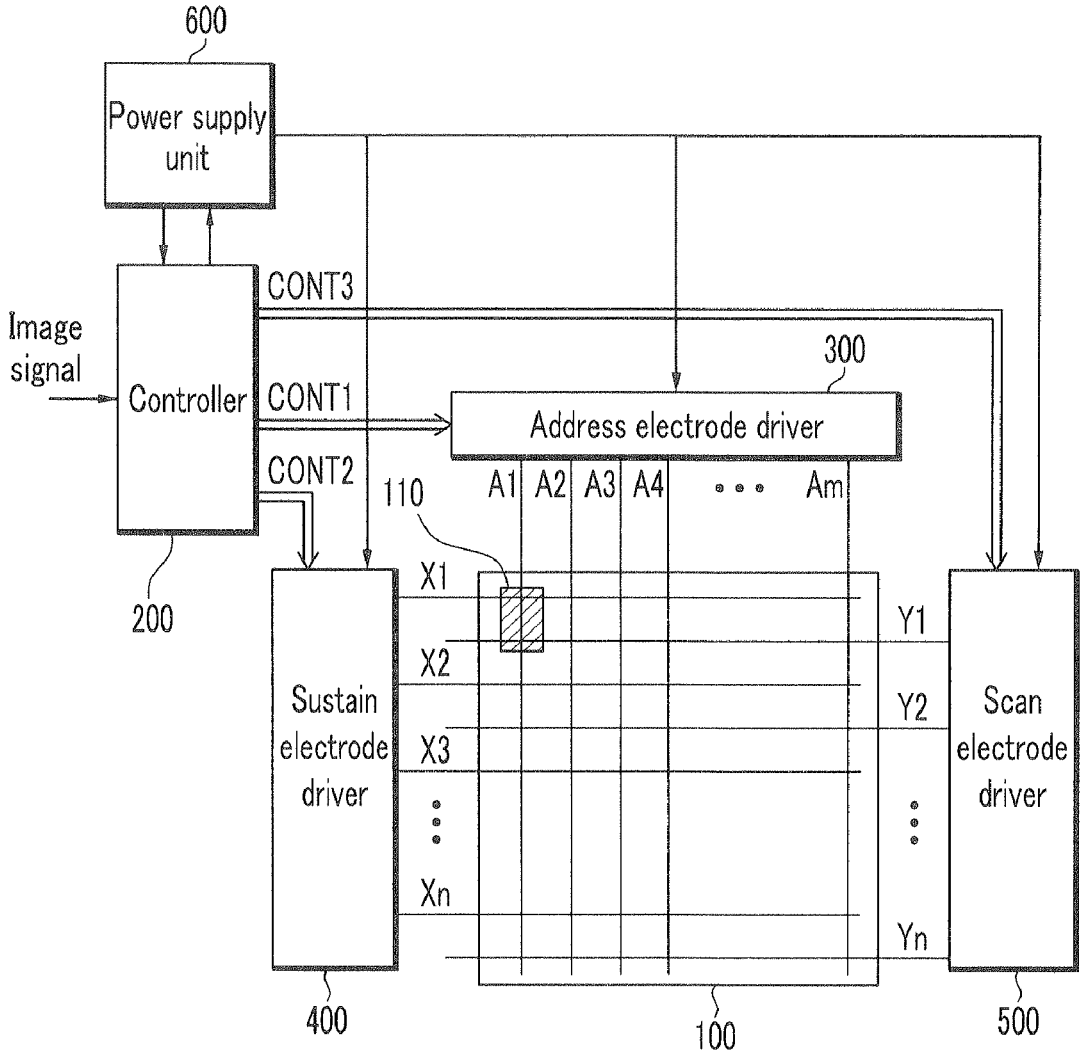
FIG. 1 is a diagram showing a plasma display device constructed as an embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification. In the specification and the claims that follow, when it is described that an element is "coupled" to another element, the element may be "directly coupled" to the other element or "electrically coupled" to the other element through a third element.

Hereinafter, a plasma display device constructed as an embodiment of the present invention and a driving apparatus thereof will be described in detail.

FIG. 1 is a diagram showing a plasma display device constructed as an exemplary embodiment of the present invention.

Referring to FIG. 1, a plasma display device constructed as an embodiment of the present invention includes a plasma display panel 100, a controller 200, an address electrode driver 300, a sustain electrode driver 400, a scan electrode driver 500, and a power supply unit 600.

The plasma display panel 100 includes a plurality of address electrodes (hereinafter, referred to as "A electrode") A1 to Am extending in a column direction and a plurality of sustain electrodes (hereinafter, referred to as "X electrode") X1 to Xn and scan electrodes (hereinafter, referred to as "Y electrode") Y1 to Yn extending in a row direction while being formed in a pair each other. Generally, the X electrodes X1 to Xn are formed corresponding to the Y electrodes Y1 to Yn, wherein the X electrodes X1 to Xn and the Y electrodes Y1 to Yn perform the display operation for displaying images in the sustain period. The Y electrodes (Y1 through Yn) and the X electrodes (X1 through Xn) are disposed to be orthogonal to the A electrodes (A1 through Am). In this configuration, the discharge space at the intersection portions between the A electrodes A1 to Am and the X and Y electrodes X1-Xn and Y1-Yn forms a discharge cell 110. In one embodiment, one A electrode, one X electrode and one Y electrode constitutes a discharge cell 110. This is an exemplary structure of the plasma display panel 100 and panels of other structures may be applied to the present invention.

The controller 200 divides one frame into a plurality of subfields each having a corresponding weight value and drives the one frame. Each subfield includes an address period and a sustain period. The controller 200 receives image signals from the exterior for driving one frame, processes the image signals to meet the plurality of subfields to generate an A electrode driving control signal CONT1, an X electrode driving control signal CONT2, and a Y electrode driving control signal CONT3, and outputs these three control signals to address, sustain and scan electrode drivers 300, 400, and 500, respectively.

The controller 200 converts the image signals corresponding to each discharge cell into subfield data indicating whether or not each discharge cell emits light in the plurality of subfields, wherein the A electrode driving control signal CONT1 includes the subfield data. The X electrode driving control signal CONT2 and the Y electrode driving control signal CONT3 include the sustain discharge control signal that controls the frequency of the sustain discharge and/or the sustain discharge operation in the sustain period of each subfield. In addition, the Y electrode driving control signal CONT3 further includes a scan control signal for controlling the scan operation in the address period of each subfield.

The scan electrode driver 500 sequentially applies the scan pulses to the Y electrodes Y1 to Yn according to the Y electrode driving control signal CONT3 in the address period. The address electrode driver 300, according to the A electrode driving control signal CONT1, applies voltage to the A electrodes (A1 through Am) for differentiating the light emitting cell from the non-light emitting cell among the plurality of discharge cells formed by the Y electrode, to which the scan pulse is applied.

The power supply unit 600 supplies power necessary to drive the plasma display device to the controller 200 and each driver 300, 400, and 500.

After the light emitting cell and the non-light emitting cell are differentiated from each other in the address period, the sustain electrode driver 400 and the scan electrode driver 500 respectively apply the sustain discharge pulse of the frequency corresponding to luminance weight values of each subfield to the X electrodes (X1 through Xn) and the Y electrodes (Y1 through Yn) according to the X electrode driving control signal CONT2 and the Y electrode driving control signal CONT3 in the sustain period.

Figure 2:
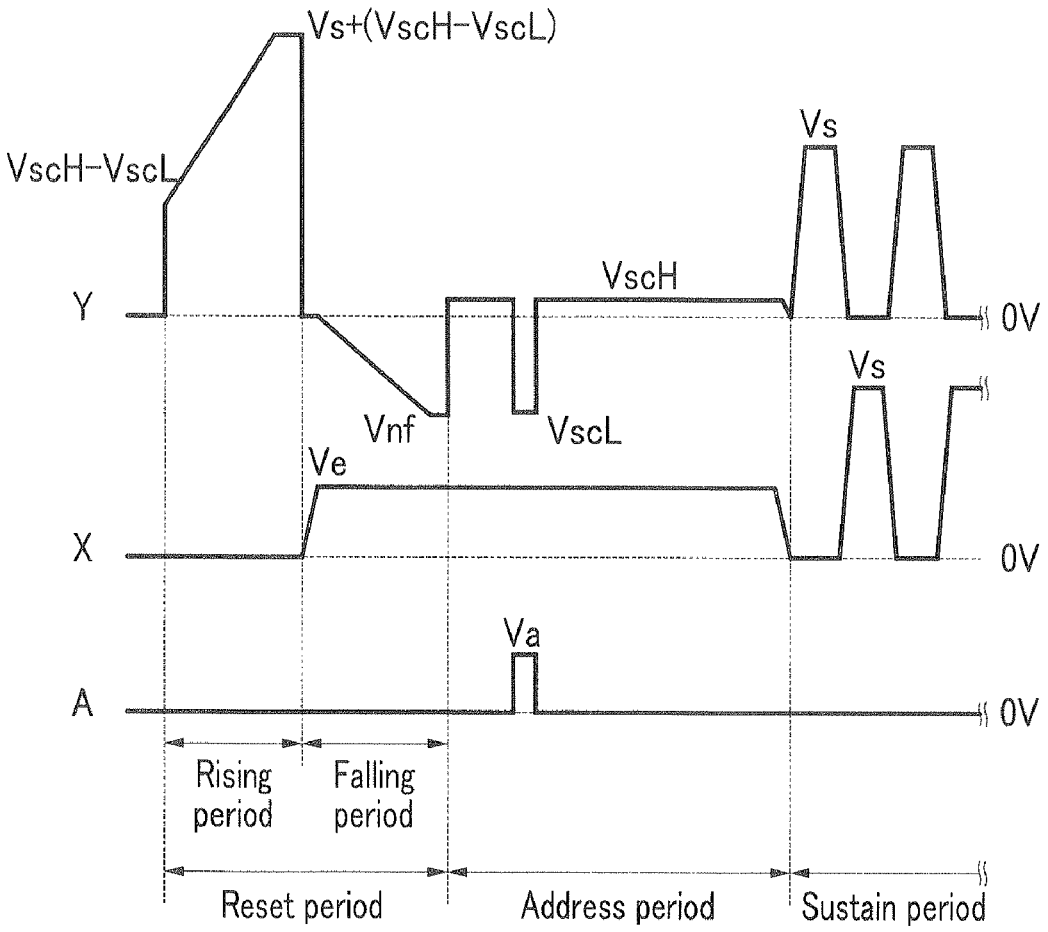
FIG. 2 is a diagram showing a driving waveform of the plasma display device constructed as an embodiment of the present invention.

FIG. 2 is a diagram showing a driving waveform of the plasma display device constructed as an exemplary embodiment of the present invention. For convenience, FIG. 2 shows only one of the plurality of subfields, and only the driving waveforms applied to the Y electrode, the X electrode, and the A electrode forming one light emitting cell will be described.

Referring to FIG. 2, the address electrode driver 300 and the sustain electrode driver 400 each bias the A electrode and the X electrode to a reference voltage (0V voltage in FIG. 2) for a rising period of the reset period. During the rising period of the reset period, the scan electrode driver 500 first increases the voltage of the Y electrode from 0V to VscH−VscL voltage, and then gradually increases from VscH−VscL voltage to Vset voltage where the Vset voltage may be Vs+(VscH−VscL) voltage. FIG. 2 shows a case in which the voltage of the Y electrode is increased in a ramp type within the raising period of the reset period. Then, a weak discharge (hereinafter, referred to as "weak discharge") is generated between the Y electrode and the X electrode and between the Y electrode and the A electrode while the voltage of the Y electrode is increased, and at the same time, negative (−) wall charge is formed in the Y electrode and positive (+) wall charge is formed in the X and A electrodes. In this case, the Vset voltage may be set to be larger than the discharge initial voltage between the X electrode and the Y electrode so that the discharge is generated in all the discharge cells. Wall charge refers to net accumulation of negative or positive charge on the dielectric layer surface of a discharge cell. The discharge initial voltage refers to a threshold voltage required for a discharge occurring between the X electrode and Y electrode. For example, the discharge initial voltage may be 200-250V.

The sustain electrode driver 400 biases the X electrode to Ve voltage and the scan electrode driver 500 lowers the voltage of the Y electrode from Vset to 0V voltage and then, gradually reduces from 0V voltage to Vnf voltage, for the falling of the reset period. In this case, the Vnf voltage may be the same as VscL voltage. FIG. 2 shows the case in which the voltage of the Y electrode is reduced in the ramp type within the falling of the reset period. Then, the weak discharge is generated between the Y electrode and the X electrode and the Y electrode and the A electrode while the voltage of the Y electrode is reduced, and at the same time, the negative (−) wall charge formed in the Y electrode and the positive (+) wall charge formed in the X electrode and the A electrode are erased.

Generally, the Ve voltage and the Vnf voltage are set to approach the wall voltage between the Y electrode and the X electrode to almost 0V, such that the discharge cell not selected in the address period does not generate the sustain discharge in the sustain period. The wall voltage refers to voltage generated by the wall charge. That is, the (Ve−Vnf) voltage is set to about discharge initial voltage between the Y electrode and the X electrode.

Thereafter, in order to select the light emitting cell and the non-emitting cell among the plurality of discharge cells in the corresponding subfield for the address period, the scan electrode driver 500 and the address electrode driver 300 applies the scan pulse having the VscL voltage and the address pulse having Va voltage to the Y electrode and the A electrode, respectively, in the state where the sustain electrode driver 400 maintains the voltage of the X electrode as the Ve voltage. The scan electrode driver 500 applies the VscH voltage higher than the VscL voltage to the Y electrode to which the scan pulse is not applied and applies the reference voltage (0V voltage in FIG. 2) to the A electrode to which the address pulse is not applied.

That is, the address electrode driver 300 applies the address pulse to the A electrode positioned at the light emitting cell in the first row of the discharge cells while the scan electrode driver 500 applies the scan pulse to the Y electrode (Y1 of FIG. 1) in the first row. Then, the address discharge is generated between the Y electrode (Y1 of FIG. 1) in the first row and the A electrode to which the address pulse is applied, so that the positive (+) wall charge is formed in the Y electrode (Y of FIG. 1) and the negative (−) wall charge is formed in the A and X electrodes, respectively. Thereafter, the address electrode driver 300 applies the address pulse to the A electrode positioned at the light emitting cell in the second row while the scan electrode driver 500 applies the scan pulse to the Y electrode (Y2 of FIG. 1) in the second row. Then, the address discharge is generated in the cell formed by the A electrode to which the address pulse is applied and the Y electrode (Y2 of FIG. 1) of the second row, such that the wall charge is formed in the cell. Similarly, the address electrode driver 300 applies the address pulse to the A electrode positioned in the light emitting cell while the scan electrode driver 500 sequentially applies the scan pulse to the Y electrode in the remaining row, thereby forming the wall charge.

In the sustain period, the scan electrode driver 500 applies the sustain discharge pulse alternately having the high level voltage (Vs in FIG. 2) and the low level voltage (0V in FIG. 2) to the Y electrode as many as the frequency corresponding to the weight value of the corresponding subfields. The scan electrode driver 500 applies the sustain discharge pulse to the X electrode in an anti-phase to the sustain discharge pulse applied to the Y electrode. As a result, the voltage difference between the Y electrode and the X electrode alternately has the +Vs voltage and the −Vs voltage, such that the sustain discharge is repeatedly generated by a predetermined frequency in the light emitting cell.

Hereinafter, the driving circuit generating the driving waveform of the plasma display device will be described with reference to FIG. 3.

Figure 3:
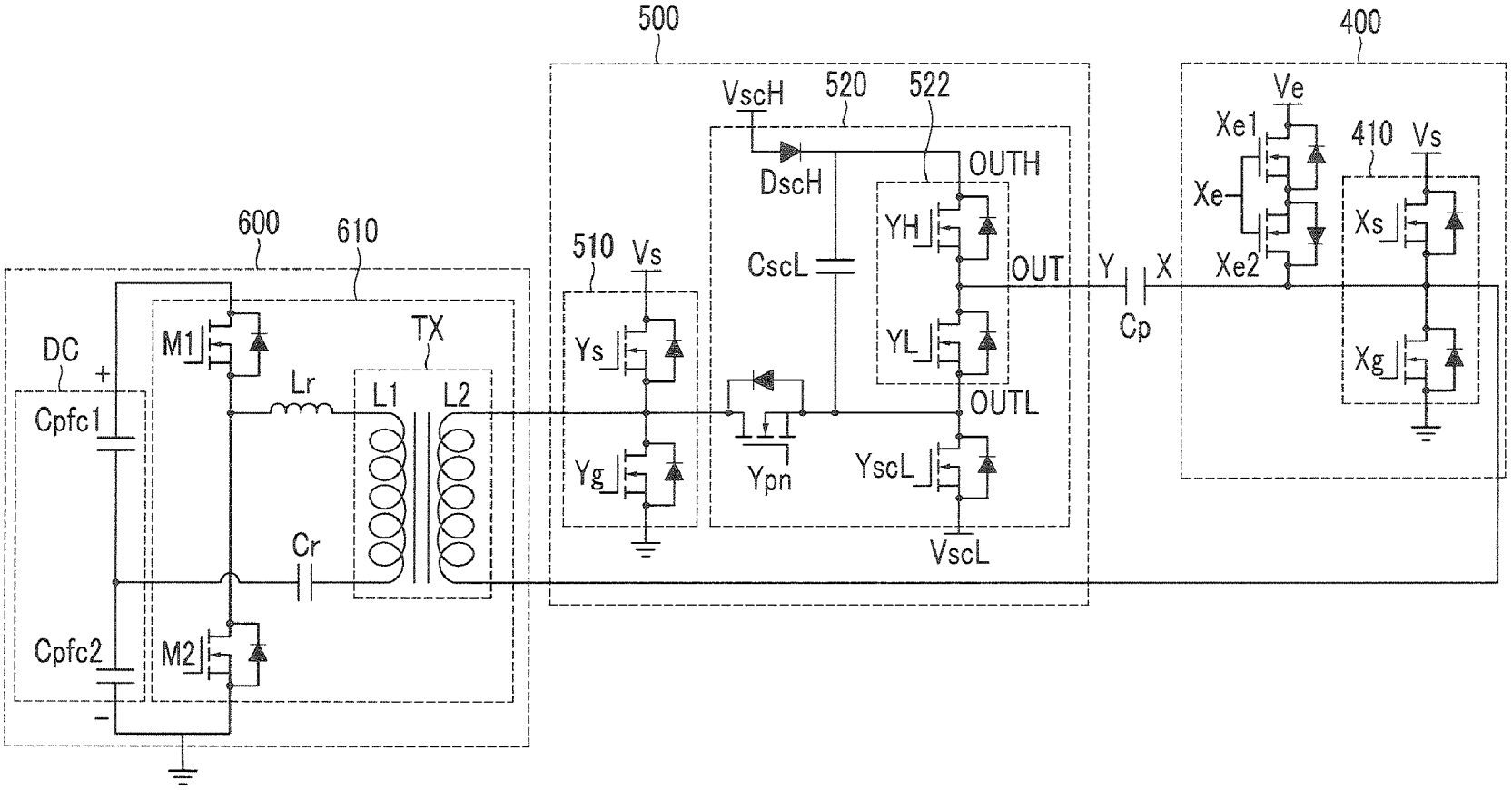
FIG. 3 is a diagram showing a driving circuit constructed as a first exemplary embodiment of the present invention.

FIG. 3 is a diagram showing a driving circuit constructed as a first exemplary embodiment of the present invention. For convenience, FIG. 3 shows only one X electrode and only one Y electrode and shows the capacitive component formed by the X electrode and the Y electrode as a capacitor (hereinafter, referred to as "panel capacitor") Cp. In addition, FIG. 3 shows only circuit for generating the driving waveform in the address period and the sustain period.

Referring to FIG. 3, the driving circuit of the sustain electrode driver 400 includes transistors Xe1 and Xe2 and a sustain discharge circuit 410.

The sustain discharge circuit 410 includes transistors Xs and Xg.

The driving circuit of the scan electrode driver 500 includes a sustain discharge circuit 510 and a scan driver 520.

The scan driver 520 includes transistors YscL and Ypn, a diode DscH, a capacitor CscL, and a scan circuit 522. The scan circuit 522 includes a high voltage terminal OUTH, a low voltage terminal OUTL, an output terminal OUT. The scan circuit 522 may include two transistors YH and YL.

In this case, each of the transistors Xe1, Xe2, Xs, Xg, Ys, Yg, YscL, Ypn, YH, and YL is a switch having a control terminal, an input terminal, and an output terminal. FIG. 3 shows the case that the transistors Xe1, Xe2, Xs, Xg, Ys, Yg, YscL, Ypn, YH, and YL are n-channel electric field effect transistors (FETs). In this case, the control terminal, the input terminal, and the output terminal correspond to a gate, a drain, and a source. These electric field effect transistors Xe1, Xe2, Xs, Xg, Ys, Yg, YscL, Ypn, YH, and YL may each be formed with a body diode. In addition, instead of the n-channel FET, other transistors similar thereto may be used as these transistors Xe1, Xe2, Xs, Xg, Ys, Yg, YscL, Ypn, YH, and YL. For example, an insulated gate bipolar transistor (IGBT) may be used as the transistors Xe1, Xe2, Xs, Xg, Ys, Yg, YscL, Ypn, YH, and YL.

In detail, two transistors Xe1 and Xe2 are coupled between the X electrode and the power supply (Ve) supplying the Ve voltage in series. In this case, the two transistors Xe1 and Xe2 are connected to each other in a back-to-back type so that the sources thereof are connected to each other or the drains thereof are connected to each other. In addition, instead of the two transistors Xb1 and Xb2 connected in the back-to-back type, one transistor may be used.

In the address period, the transistors Xe1 and Xe2 are turned-on, the Ve voltage is applied to the X electrode.

In the sustain discharge circuit 410, the drain of the transistor Xs is connected to the power supply supplying the high level voltage Vs of the sustain discharge pulse and the source thereof is connected to the X electrode. The transistor Xs is turned-on when applying the high level voltage Vs of the sustain discharge pulse to the X electrode in the sustain period. The drain of the transistor Xg is connected to the X electrode and the source thereof is connected to the power supply supplying the low level voltage 0V of the sustain discharge pulse, for example, the ground terminal. The transistor Xg is turned-on when the low level voltage 0V of the sustain discharge pulse is supplied to the X electrode in the sustain period.

In the scan driver 520, the drain of the transistor YscL is connected to the low voltage terminal OUTL and the source thereof is connected to the power supply VscL supplying the Vscl voltage. The capacitor CscL is connected between the high voltage terminal OUTH and the low voltage terminal OUTL of the scan circuit 522. The capacitor CscL charges the (VscH-VscL) voltage. The anode of the diode DscH is connected to the power supply VscH supplying the VscH voltage and the cathode of the diode DscH is connected to the low voltage terminal OUTL of the scan circuit 522.

The drain of the transistor YH of the scan circuit 522 is connected to the high voltage terminal OUTH and the source thereof is connected to the output terminal OUT and the drain of the transistor YL is connected to the output terminal OUT and the source thereof is connected to the low voltage terminal OUTL.

One scan circuit 522 may correspond to one Y electrode and the scan driver 520 may be formed with the plurality of scan circuits each corresponding to the plurality of Y electrodes (Y1 to Yn of FIG. 1). In this case, at least a part of a plurality of scan circuits is formed as one integrated circuit (IC), wherein the high voltage terminal OUTH and the low voltage terminal OUTL of theses scan circuits each may be formed in common.

In the address period, the transistor YscL is turned-on so that the voltage of the low voltage terminal OUTL of the scan circuit 522 becomes the VscL voltage and the voltage of the high voltage terminal OUTH of the scan circuit 522 becomes the VscH voltage. The transistors YL of the plurality of scan circuits 522 are sequentially turned-on, such that the plurality of scan circuits 522 sequentially apply the voltage VscL of the low voltage terminal OUTL to the plurality of Y electrodes. Among the plurality of scan circuits 522, the scan circuit 522 in which the transistor YL is not turned-on applies the voltage of the high voltage terminal OUTH, that is, the VscH voltage to the Y electrode connected to the output terminal OUT by turning-on the transistor YH.

In addition, since the VscL voltage is a negative voltage, the transistor Ypn may be formed on the path in order to interrupt the flowing of current into the power supply VscL through the body diode of the transistor Yg from the ground terminal when the transistor YscL is turned-on. In other words, the source of the transistor Ypn is connected to the drain of the transistor YscL and the drain of the transistor Ypn may be connected to the drain of the transistor Yg.

Next, in the sustain discharge circuit 510, the drain of the transistor Ys is connected to the power supply supplying the high level voltage Vs of the sustain discharge pulse and the source thereof is connected to the Y electrode. The transistor Ys is turned-on when the high level voltage Vs of the sustain discharge pulse is applied to the Y electrode in the sustain period. The drain of the transistor Yg is connected to the Y electrode and the source thereof is connected to the power supply supplying the low level voltage 0V of the sustain discharge pulse, for example, the ground terminal. The transistor Yg is turned-on when the low level voltage 0V of the sustain discharge pulse is applied to the Y electrode in the sustain period.

These sustain discharge circuits 410 and 510 perform the operation of the energy recovery circuit in the sustain period by using the circuits of the power supply unit 600 supplying power required in each driver 300, 400, and 500.

The power supply unit 600 includes capacitors Cpfc1 and Cpfc2 and a DC/DC converter 610.

The DC/DC converter 610 converts the voltage charged in the capacitors Cpfc1 and Cpfc2 into the DC voltage for driving the plasma display device. An example of the DC voltage for driving the plasma display device may include Vs voltage, Vset voltage, VscL voltage, Vnf voltage, VscH voltage, or the like, for the driving waveform of FIG. 2. FIG. 3 is a diagram showing an LLC resonance converter as the DC/DC converter 610. However, other converter may be used as the DC/DC converter 610.

The DC/DC converter 610 includes transistors M1 and M2, an inductor Lr, a capacitor Cr, and a transformer TX. The transformer TX includes a primary coil L1 and a secondary coil L2.

Herein, the transistors M1 and M2 each are a switch having a control terminal, an input terminal, and an output terminal. FIG. 3 shows the case in which the transistors M1 and M2 are the n-channel electric field effect transistor (FET). In this case, the control terminal, the input terminal, and the output terminal each corresponds to the gate, drain, and source. The electric field effect transistors M1 and M2 may each be formed with a body diode (not shown). In addition, instead of the n-channel FET, other transistors having functions similar thereto may be used as theses transistors M1 and M2. For example, IGBT may be used as the transistor M1 and M2. For example, IGBT may be used as the transistors M1 and M2.

In the DC/DC converter 610, the drain of the transistor M1 is connected to one terminal (+) of the DC power supply supplying the DC voltage, the source of the transistor M1 is connected to the drain of the transistor M2, and the source of the transistor M2 is connected to other terminal (−) of the DC power supply. These transistors M1 and M2 are each turned-off by the control signals transferred from the controller (200 of FIG. 1) and the two control signals have an anti-phase to each other, such that one of two transistors M1 and M2 may be turned-on and the other thereof may be turned-off.

The DC power supply may include the capacitors Cpfc1 and Cpfc2 connected in series. One terminal of the capacitor Cpfc1 is connected to the drain of the transistor M1, the other terminal of the capacitor Cpfc1 is connected to one terminal of the capacitor Cpfc2, and the other terminal of the capacitor Cpfc2 is connected to the source of the transistor M2. The capacitors Cpfc1 and Cpfc2 are each charged with the DC voltage Vpfc/2 being subjected to power factor compensation after performing full-wave rectification on AC voltage.

One terminal of the inductor Lr is connected to the source of the transistor M1 and the other terminal of the inductor Lr is connected to one terminal of a primary coil L1 of the transformer TX. The other terminal of the primary coil L1 of the transformer TX is connected to contacts of the capacitors Cpfc1 and Cpfc2 through the capacitor Cr. One terminal of the secondary coil L2 of the transformer TX is connected to the low voltage terminal OUTL and the other terminal of the secondary coil L2 of the transformer TX is connected to the X electrode.

Meanwhile, the transformer TX has leakage inductance and magnetizing inductance and may use the leakage inductance of the transformer TX as the inductor Lr. The power supply unit 600 may be formed with at least one of DC/DC converter 610 in order to generate voltage required in the plasma display device.

The sustain discharge circuits 410/510 constructed as the exemplary embodiment of the present invention apply the sustain discharge pulse to the X/Y electrode using the DC/DC converter 610.

In detail, the turn-on and turn-off of the transistors M1 and M2 are repeated in the DC/DC converter 610 before the transistor Xs/Ys is turned-on. The resonance is generated between the inductor Lr and the capacitor Cr by the turn-on of the transistors M1 and M2, and the resonance is generated between the secondary coil L2 of the transformer TX and the panel capacitor Cp. The panel capacitor Cp is charged with energy charged in the capacitor Cpfc1 and Cpfc2 by the resonance between the secondary coil L2 of the transformer TX and the panel capacitor Cp. Therefore, the voltage of the X/Y electrode is increased from 0V to Vs voltage. In this case, the power supply Vs is charged through the body diode of transistors Xs and Yg and/or transistors Ys and Xg while the voltage across the secondary coil L2 of the transformer TX is increased to Vs voltage or more.

In addition, the sustain discharge circuits 410/510 generate the resonance between the secondary coil L2 of the transformer TX and the capacitor Cp by repeatedly turning-on and turning-off the transistors M1 and M2 in the DC/DC converter 610 before the transistors Xg/Yg are turned-on, thereby recovering the energy discharged from the panel capacitor Cp to the capacitors Cpfc1 and Cpfc2. Therefore, the voltage of the X/Y electrode may be reduced from the Vs voltage to the vicinity of 0V.

As such, the driving circuit according to the first exemplary embodiment of the present invention may simultaneously perform the operation of the energy recovery circuit and the operation of generating the Vs power by using the circuit of the power supply unit 600. Therefore, the circuit devices of the driving circuit may be reduced since the energy recovery circuit does not have to be formed in the sustain electrode driver 400 and the scan electrode driver 500, respectively.

Hereinafter, the operation of the driving circuit according to the first exemplary embodiment of the present invention will be described in detail. For the convenience of explanation, only the operation of the driving circuit for generating the sustain discharge pulse will now be described.

Figure 4:
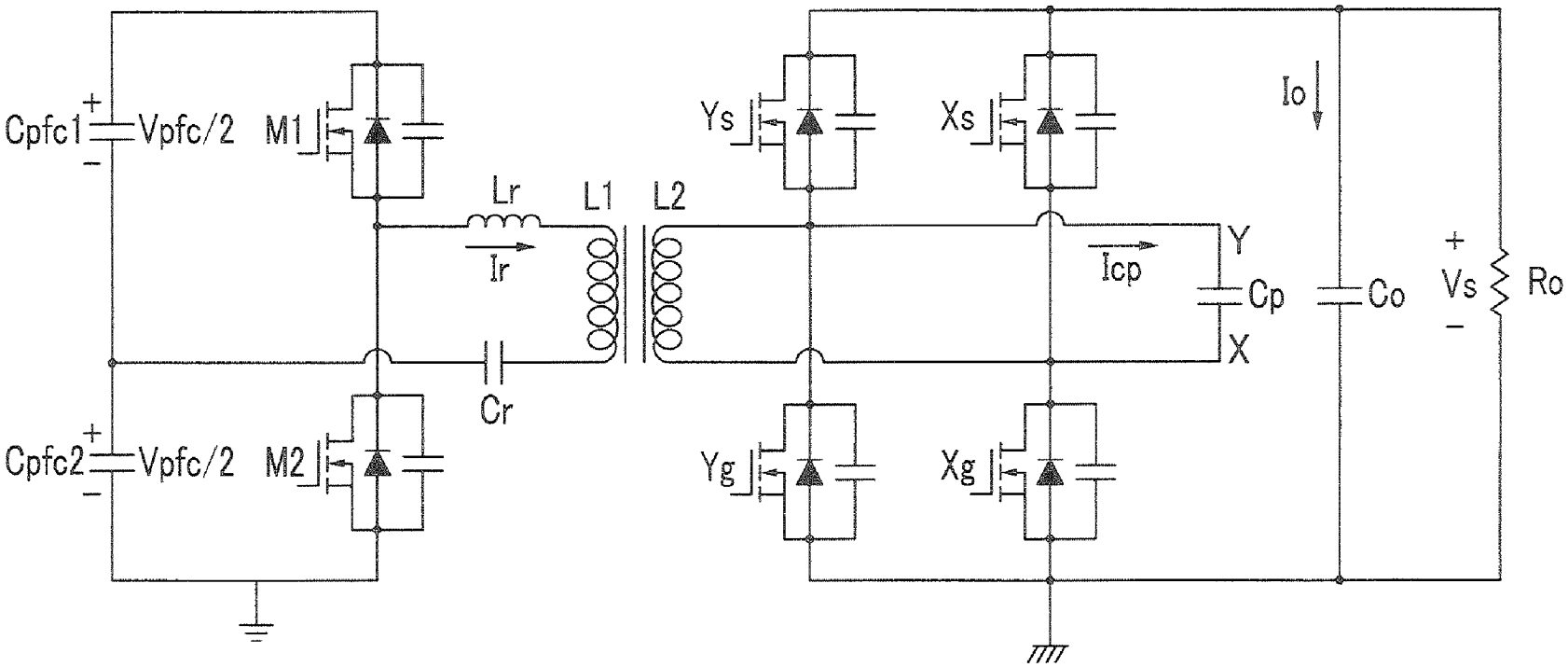
FIG. 4 is a modeling diagram showing only the driving circuit for generating a sustain discharge pulse in the driving circuit of FIG. 3.
Figure 5:
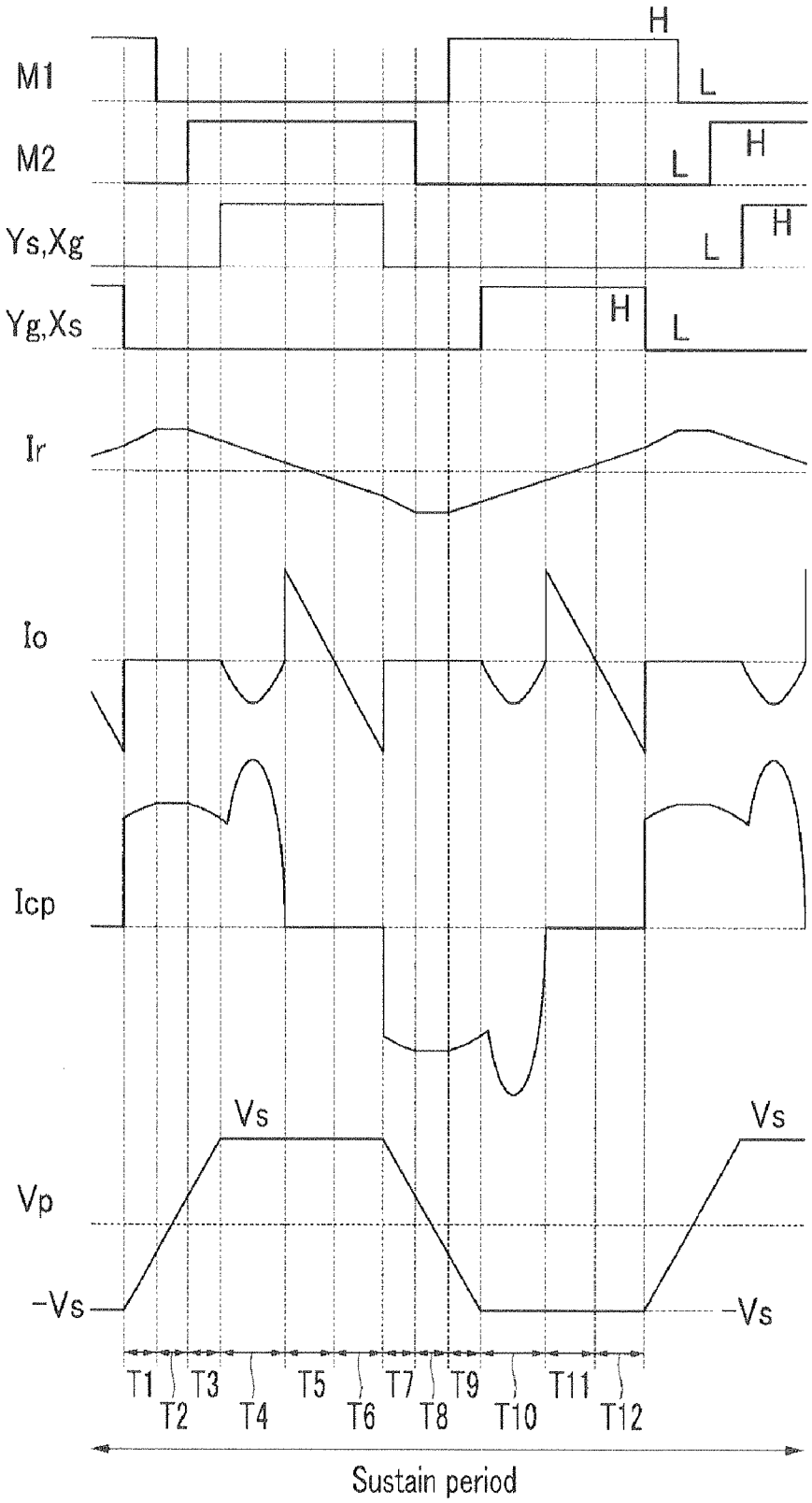
FIG. 5 is a signal timing diagram of the driving circuit shown in FIG. 4.

FIG. 4 is a modeling diagram showing only the driving circuit for generating a sustain discharge pulse in the driving circuit of FIG. 3, FIG. 5 is a signal timing diagram of the driving circuit shown in FIG. 4, and FIGS. 6A through 6J are diagrams showing a current path according the signal timing diagram shown in FIG. 5.

FIG. 5 shows the voltage of the control signal applied to the gates of the transistors Ys, Yg, Xs, Xg, M1, and M2 in order to represent the turn-on/turn-off state of the transistors Ys, Yg, Xs, Xg, M1, and M2. In this exemplary embodiment, when the voltage of the control signal is in the high level, the transistors Ys, Yg, Xs, Xg, M1, and M2 are turned-on, and when the voltage of the control signal is in the low level, the transistors Ys, Yg, Xs, Xg, M1, and M2 are turned-off.

The driving circuit shown in FIG. 3, and the circuit device used to generate the sustain discharge pulse may be modeled as shown in FIG. 4.

In FIG. 4, the load resistance Ro may imply a power supply supplying the high level voltage Vs of the sustain discharge pulse and the load capacitor Co may be connected to the load resistance Ro in parallel.

Since the sustain discharge pulse applied to the Y electrode is applied to the Y electrode through the low voltage terminal OUTL of the scan circuit 522, it is assumed that the transistor YL is turned-on in the sustain period.

Figure 6A:
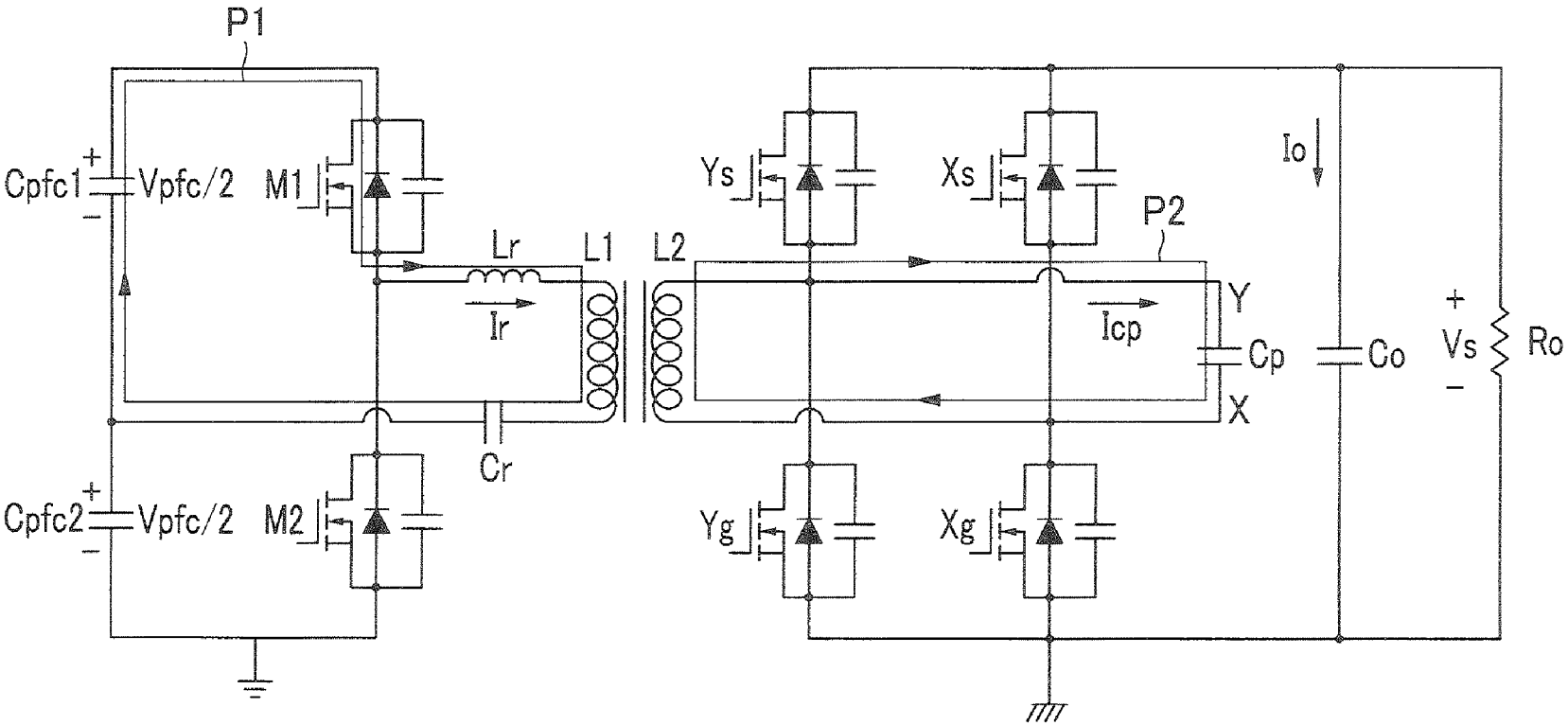
Figure 6B:
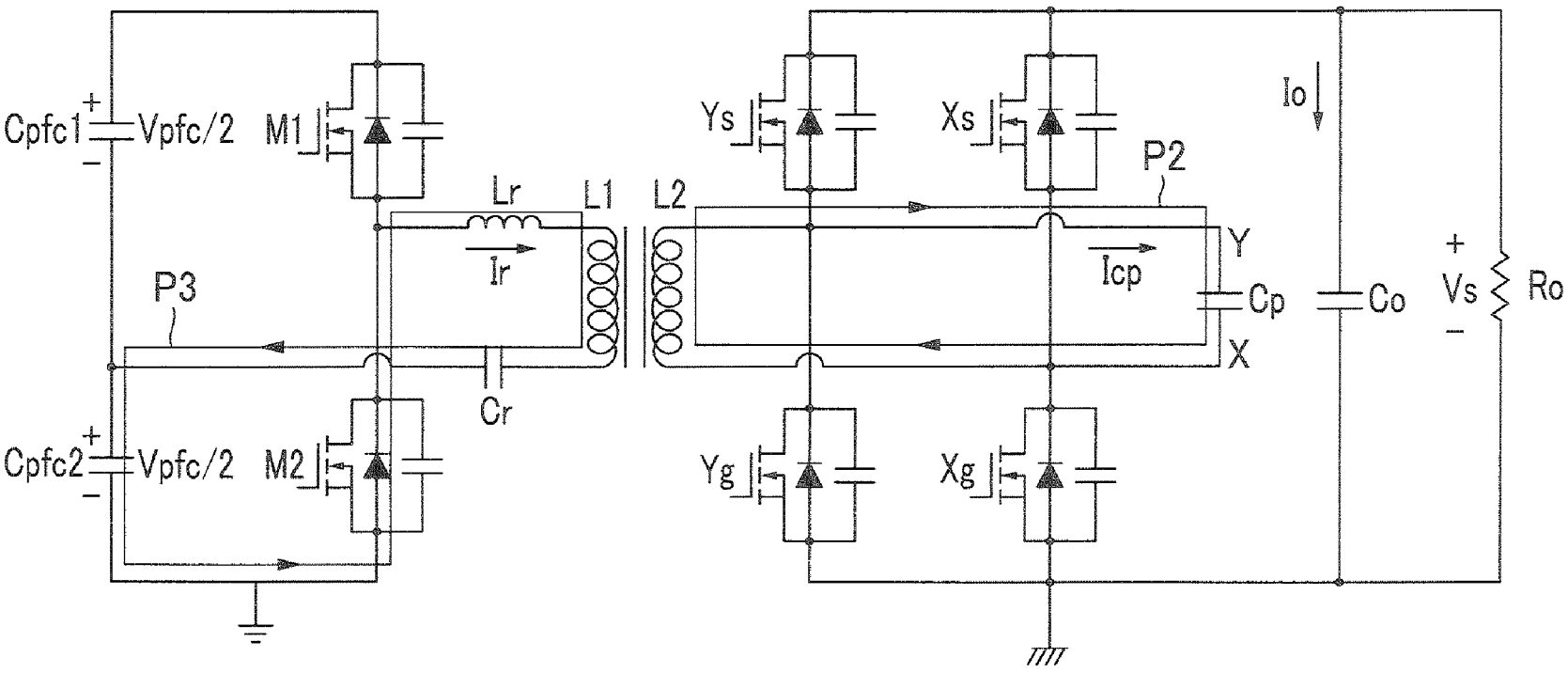

Referring to FIGS. 5 and 6A, the transistors Yg and Xs are turned-off in the state where the transistor M1 is turned-on in the sustain period, such that the period T1 starts. When the transistors Yg and Xs are turned-off, the resonance between the inductor Lr and the capacitor Cr is generated through the current path P1 shown in FIG. 6A, such that the current Ir (hereinafter, referred to as the primary side current) flowing into the inductor Lr is continuously increased. The resonance between the secondary coil L2 and the panel capacitor Cp is generated through the current path P2 shown in FIG. 6A while the primary side current Ir is induced to the secondary coil L2 of the transformer TX. The voltage Vp of the panel capacitor Cp starts to increase while the current Icp (hereinafter, referred to as "panel current") flowing into the panel capacitor Cp is increased by the resonance between the secondary coil L2 and the panel capacitor Cp.

The resonance period is in proportion to the square root of the capacitance of the capacitor forming the resonance path and is in inverse proportion to the turn ratio of current flowing into the inductor Lr. A parasitic capacitor is formed between the sources and drains of each of the transistors Ys, Yg, Xs, Xg, M1, and M2 as shown in FIG. 4. Therefore, the resonance period at the current path P1 may be determined by the panel capacitor Cp and the capacitance of the parasitic capacitor of the transistors Ys, Yg, Xs, and Xg. In addition, the current flowing into the inductor Lr may be controlled by the turn-on/off time of the transistors M2 and M2 and transistors Ys, Xg/Xs, and Yg. The rising slope increasing from 0V to the Vs voltage in the sustain discharge pulse and the falling slope reducing from the VS voltage to 0V in the sustain discharge pulse may be controlled by controlling the magnitude in current flowing into the inductor Lr. In other words, when the current flowing into the inductor Lr is increased, the rising slope and the falling slope are increased and when the current flowing to the inductor Lr is reduced, the rising slope and the falling slope are reduced.

Next, the transistor M1 is turned-off, such that the period T2 starts. When the transistor M1 is turned-off, the primary side current Ir flows through the current path P3 shown in FIG. 6B. Then, the primary side current Ir flowing during the period T1 starts to reduce. However, the voltage Vp of the panel capacitor Cp is continuously increased by the current path P2 by the current charged in the inductor Lr in the period T1.

Next, the transistor M2 is turned-on for zero voltage switching, such that the period T3 starts. Herein, before the direction of the primary side current Ir is changed, the transistor M2 may be turned-on. In the period T3, the primary side current Ir is reduced similar to the period T2 through the current path P3 shown in FIG. 6B and is continuously increased through the voltage Vp current path P2 of the panel capacitor Cp by the current charged in the inductor Lr.

In addition, in the periods T1 to T3, the voltage of the load capacitor Co is larger than the voltage of the panel capacitor Cp, such that the current Io does not flow into the load capacitor Co.

Figure 6C:
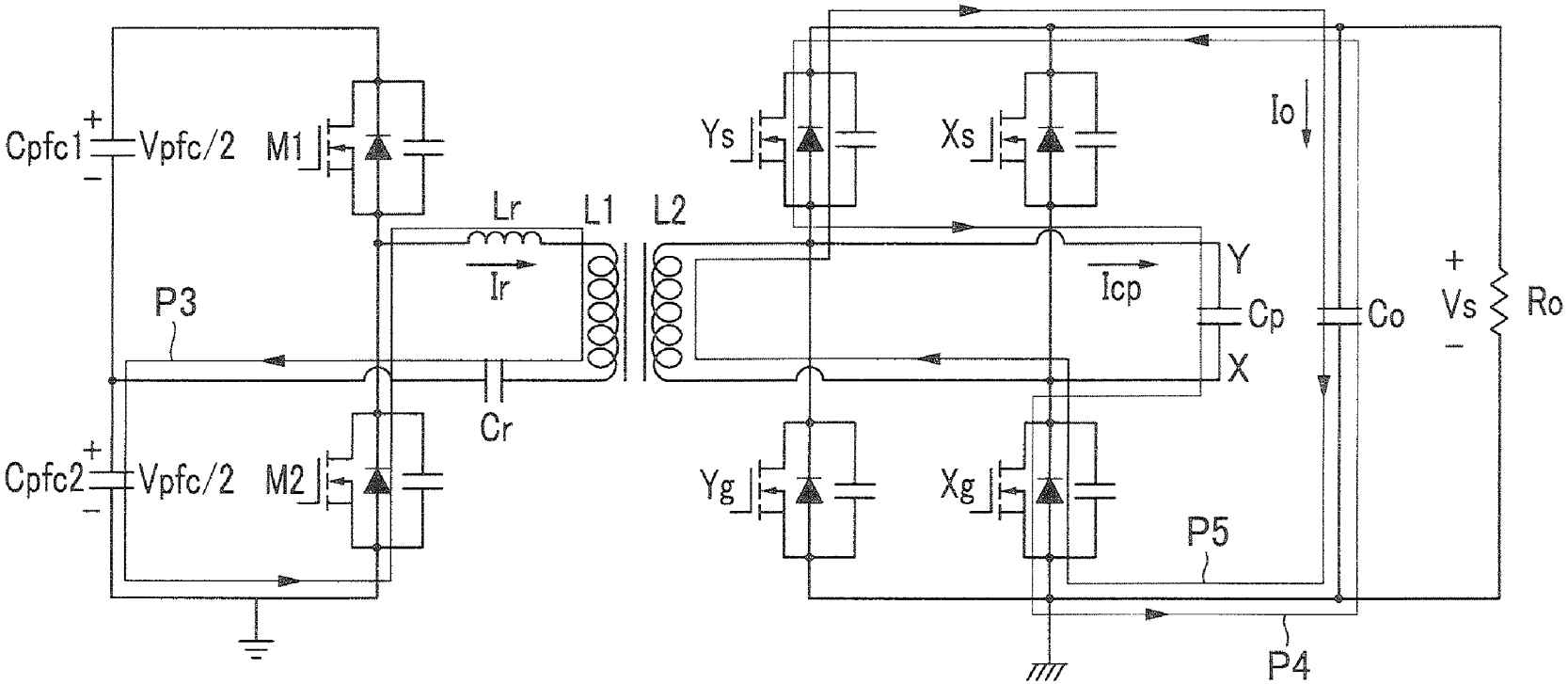

When the voltage Vp of the panel capacitor Cp rises to the vicinity of the Vs voltage, as shown in FIG. 5, the transistors Ys are Xg are turned-on, and the period T4 starts. The primary side current Ir is still reduced by the current path P2 and the current Io flowing into the load capacitor Co is reduced while the current path P4 shown in FIG. 6C is formed by turning-on the transistors Ys and Xg. Further, the Vs voltage is applied to the Y electrode by the current path P4 and 0V is applied to the X electrode, such that the voltage Vp of the panel capacitor Cp becomes the Vs voltage. In this case, the sustain discharge is generated between the Y electrode and the X electrode, such that the panel current Icp is generated as shown in FIG. 5.

Meanwhile, when the voltage Vp of the panel capacitor Cp becomes the Vs voltage, the current path P5 shown in FIG. 6C may be formed through the body diode of the transistors Ys and Xg.

Figure 6D:
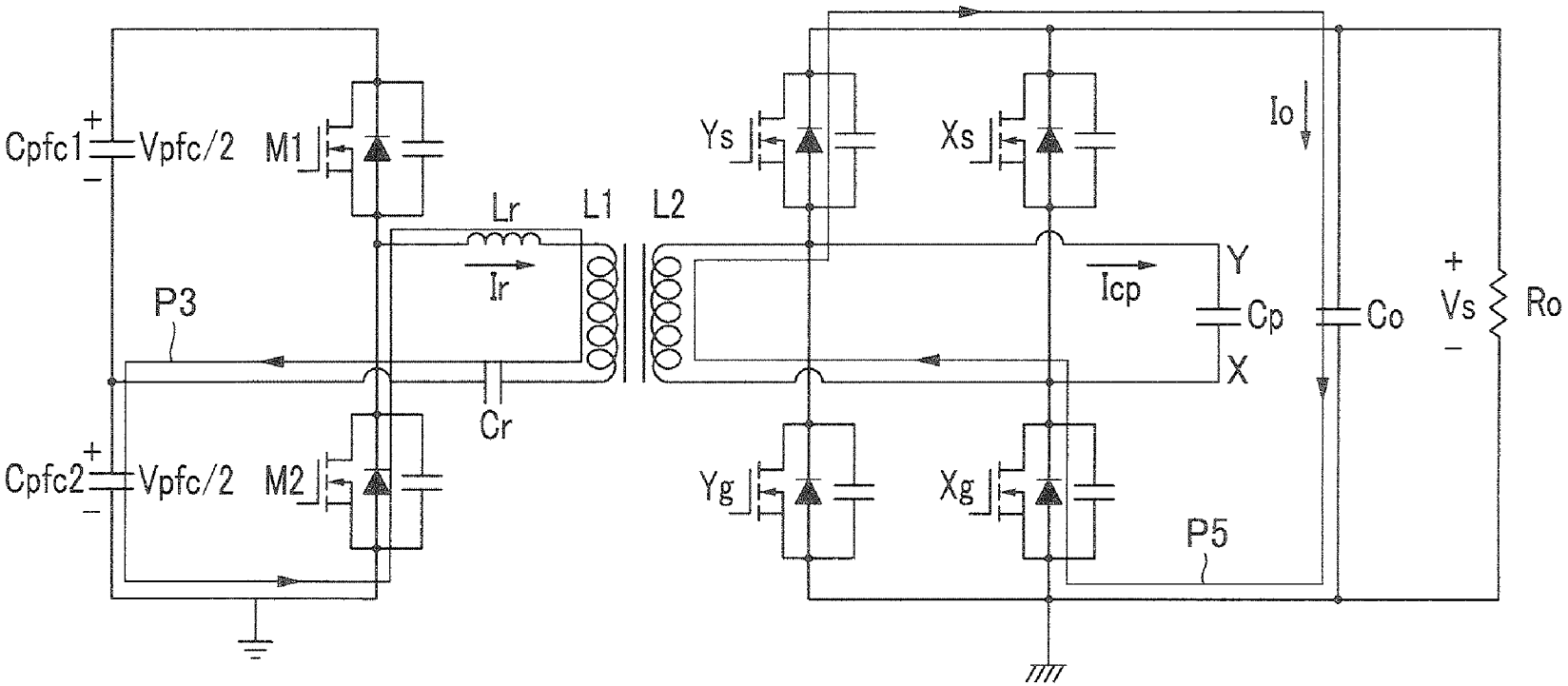

When the panel current Icp is almost 0 by the sustain discharge, the period T5 starts. Even in the period T5, the primary side current Ir is continuously reduced while the current path P3 is still formed. In addition, the voltage Vp of the panel capacitor Cp becomes the Vs voltage, such that the voltage charged in the capacitor Cpfc2 is recovered to the load capacitor Co and the voltage Vp of the panel capacitor Cp maintains the Vs voltage while the current path P5 shown in FIG. 6D is formed. As described above, the period T5 at which the voltage charged in the capacitor Cpfc2 is recovered to load capacitor Co is referred to as a powering period.

Figure 6E:
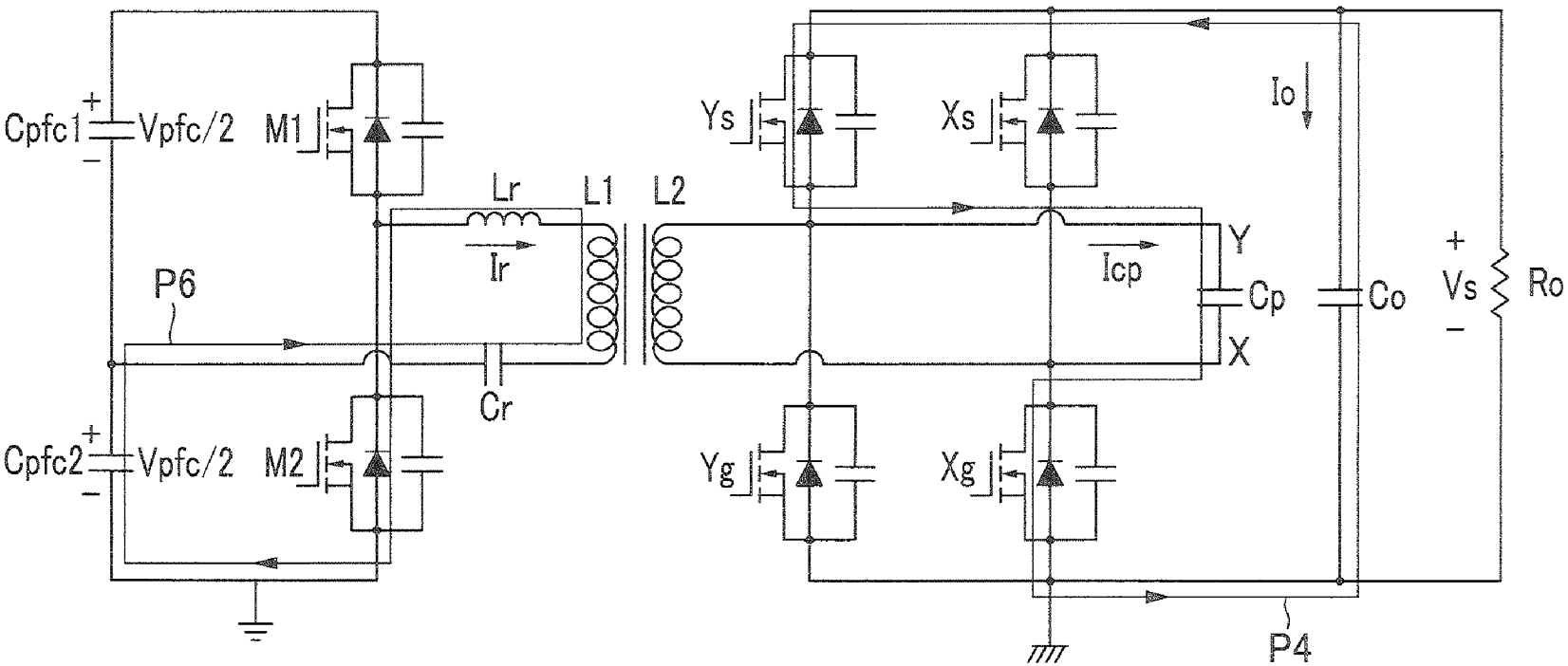

Meanwhile, when the primary side current Ir is almost 0, the period T6 starts. That is, the primary side current Ir is continuously reduced while the current direction is changed by the inductor Lr and the current path P6 shown in FIG. 6E is formed through the transistor M2. In addition, when the Vs voltage is charged in the load capacitor Co, as shown in FIG. 6E, the current Io flowing into the load capacitor Co is reduced while the current path P4 is formed and the voltage Vp of the panel capacitor Cp maintains Vs voltage.

Figure 6F:
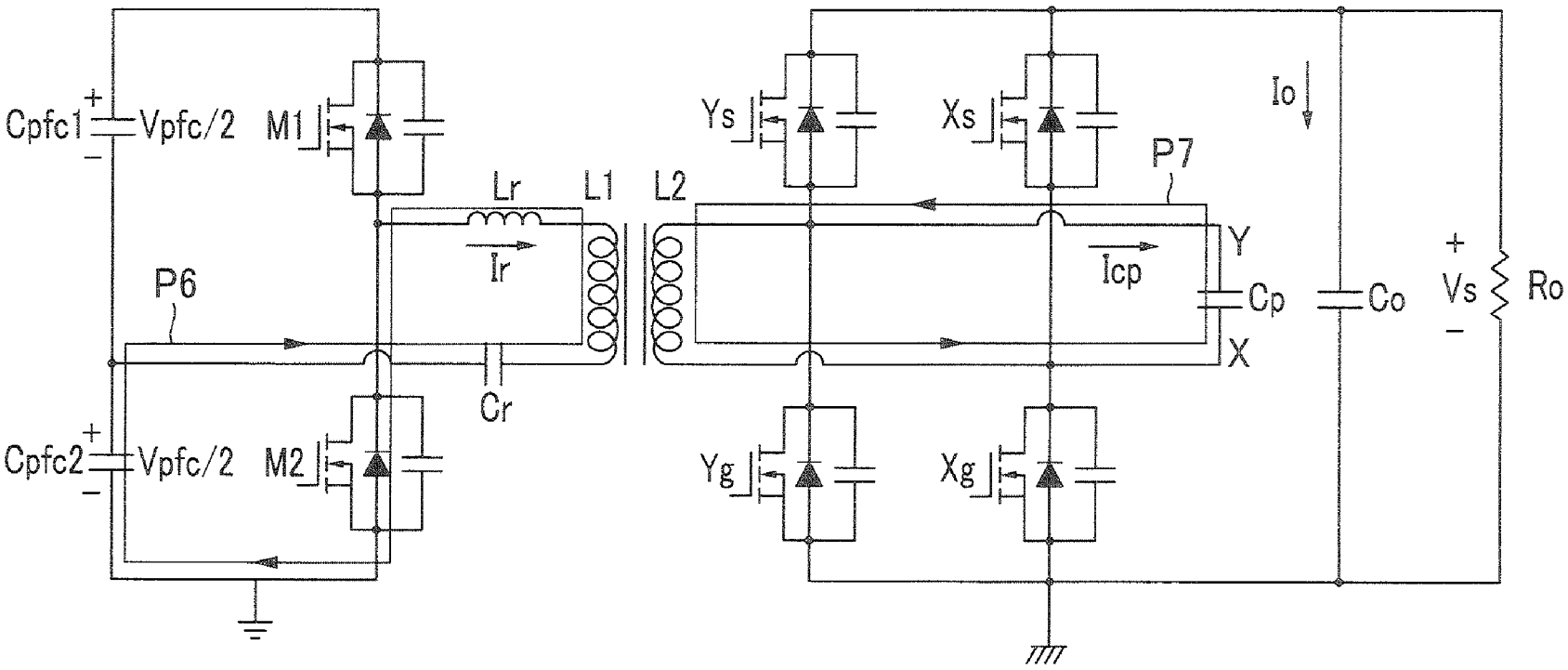

Then, when the transistors Ys and Xg are turned-off, the period T7 starts. The primary side current Ir is continuously reduced by the current path P6. In addition, the resonance between the secondary coil L2 and the panel capacitor Cp is generated while the current path P7 shown in FIG. 6F is formed by the turn-off of the transistors Ys and Xg and the voltage Vp of the panel capacitor Cp starts to reduce while the voltage Vp of the panel capacitor Cp is recovered to the capacitor Cpfc2 by the resonance.

Figure 6G:
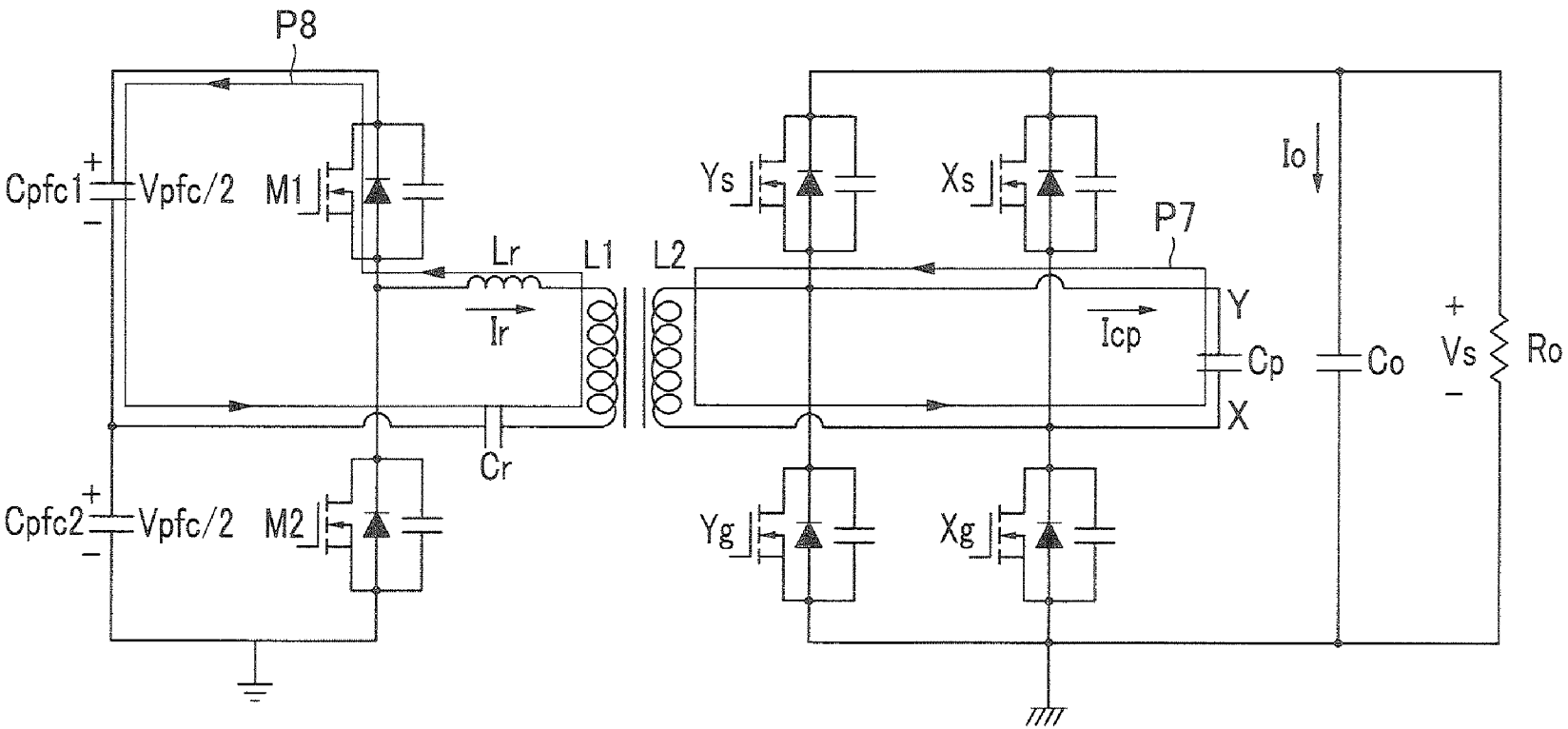

Thereafter, the transistor M2 is turned-off, such that the period T8 starts. When the transistor M2 is turned-off, the primary side current Ir starts to increase while the current path P8 shown in FIG. 6G is formed through the body diode of the transistor M1. In addition, the voltage Vp of the panel capacitor Cp is recovered to the capacitor Cpfc1 due to the resonance between the secondary coil L2 and the panel capacitor Cp by the current path P7, such that the voltage Vp of the panel capacitor Cp is continuously reduced.

Then, the transistor M1 is turned-on for zero voltage switching, such that the period T9 starts. Herein, before the direction of the primary side current Ir is changed, the transistor M2 may be turned-on. In the period T9, the primary side current Ir is increased through the current path P8 shown in FIG. 6G and the voltage Vp of the panel capacitor Cp is recovered to the capacitor Cpfc1 by the resonance between the secondary coil L2 and the panel capacitor Cp by the current path P7, such that the voltage Vp of the panel capacitor Cp is reduced to the vicinity of the −Vs voltage.

When the voltage Vp of the panel capacitor Cp falls to about −Vs voltage, the transistors Xs and Yg are turned-on and the period T10 starts.

Figure 6H:
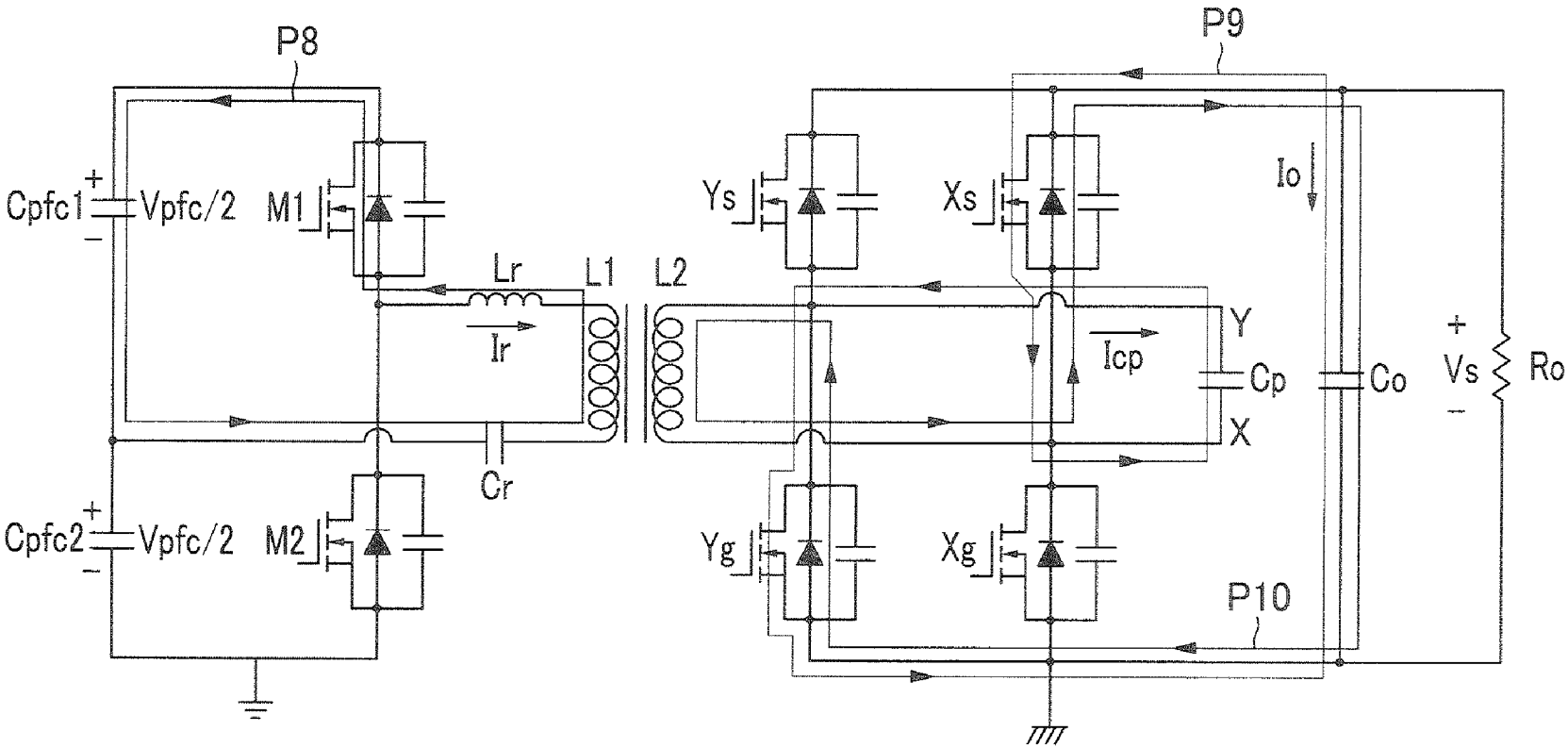
Figure 61:
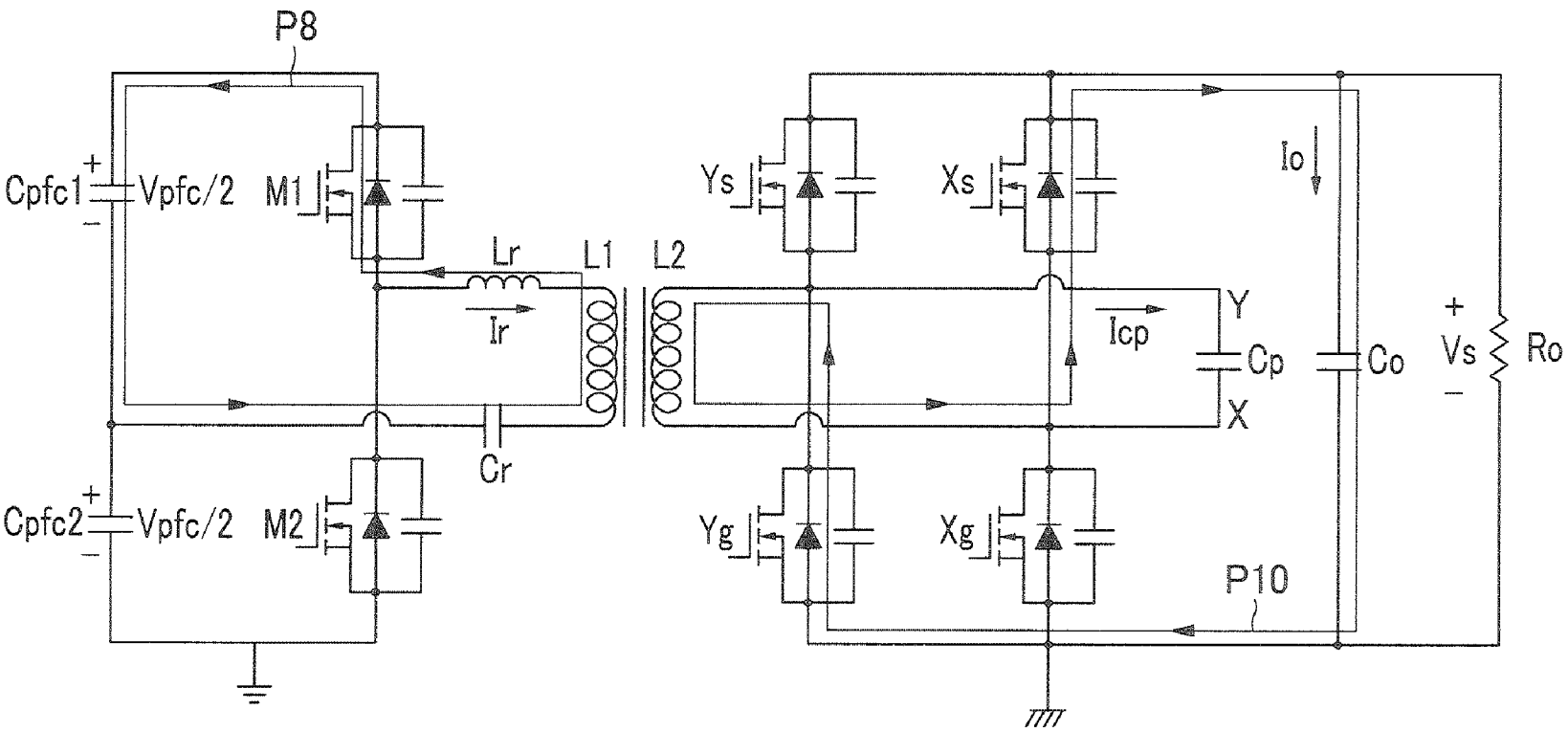

In the period 110, the primary side current Ir is continuously increased by the current path P8 and the current Io flowing into the load capacitor Co is reduced while the current path P9 shown in FIG. 6H is formed by the turn-on of the transistors Xs and Yg. In addition, the Vs voltage is applied to the X electrode by the current path P9 and 0V is applied to the Y electrode, such that the voltage Vp of the panel capacitor Cp becomes the −Vs voltage. In this case, the sustain discharge occurs between the Y electrode and the X electrode, such that the panel current Icp is generated as shown in FIG. 5.

When the panel current Icp is almost 0 by the sustain discharge, the period T11 starts. In the period T11, the load capacitor Co is charged with the voltage charged in the capacitor Cpfc1 while the current path P10 shown in FIG. 6H is formed and the current Io flowing into the load capacitor Co is increased and the voltage Vp of the panel capacitor Cp maintains −Vs voltage. As described above, a period T10 at which the voltage charged in the capacitor Cpcf1 is recovered to the load capacitor Co is referred to as a powering period.

Figure 6J:
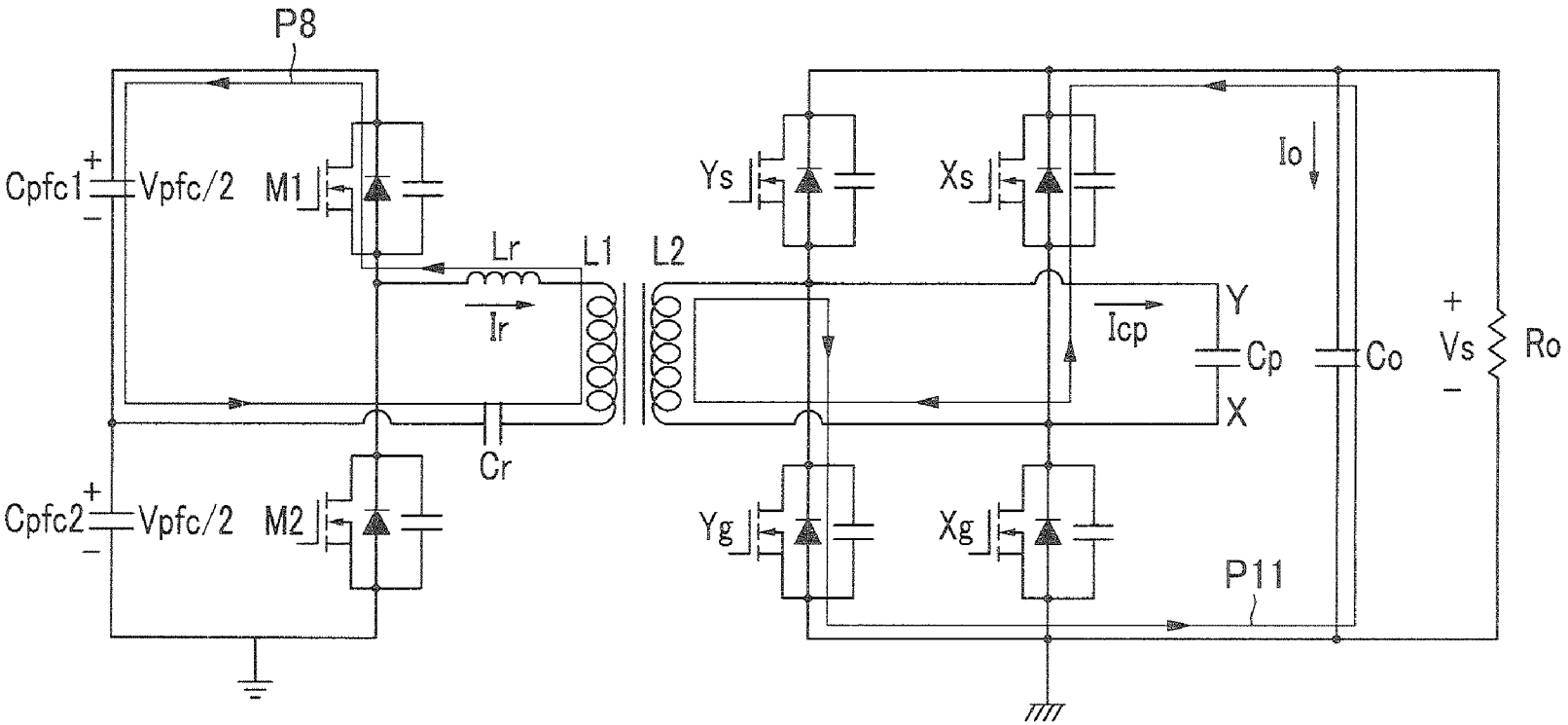

Next, when the primary side current Ir becomes almost 0, the period 112 starts. In this case, the primary side current Ir is continuously increased while the current path P1 shown in FIG. 6J is formed by the transistor M1. The current path P11 shown in FIG. 6J is formed while the primary side current Ir is induced to the secondary coil L2 of the transformer TX. The current Io flowing into the load capacitor Co is reduced and the voltage Vp of the panel capacitor Cp maintains −Vs voltage, by the current path P11.

Then, when the transistors Xs and Yg are turned-on, the period T12 ends.

The sustain electrode and scan electrode driver 400 and 500 repeat the periods T1 to T12 by the frequency corresponding to the weight value of the corresponding subfield for the sustain period. The voltage difference between the X electrode and the Y electrode alternately has the Vs voltage and the −Vs voltage, such that the sustain discharge is generate by the frequency corresponding to the weight value of the corresponding subfield.

Meanwhile, referring to FIGS. 6A through 6J, power is recovered to the load capacitor Co only in the periods T5 and T10. As described above, when the powering period is short in the sustain period, the number of sustain discharge pulses is small and it may be difficult to maintain the voltage of the Y electrode and the X electrode to the Vs voltage in the subfield having the large screen load. In addition, in the first sustain discharge pulse of the reset period or the sustain period, when the period of applying the Vs voltage to the Y electrode is long, a period of applying the Vs voltage corresponding to the DC voltage to the secondary coil L2 of the transformer is long while a closed loop is formed between the transformer TX and the load capacitor Co. Therefore, the saturation problem of the transformer TX may occur. The driving circuit in order to solve the problem will be described in detail with reference to FIGS. 7 through 10.

Figure 7:
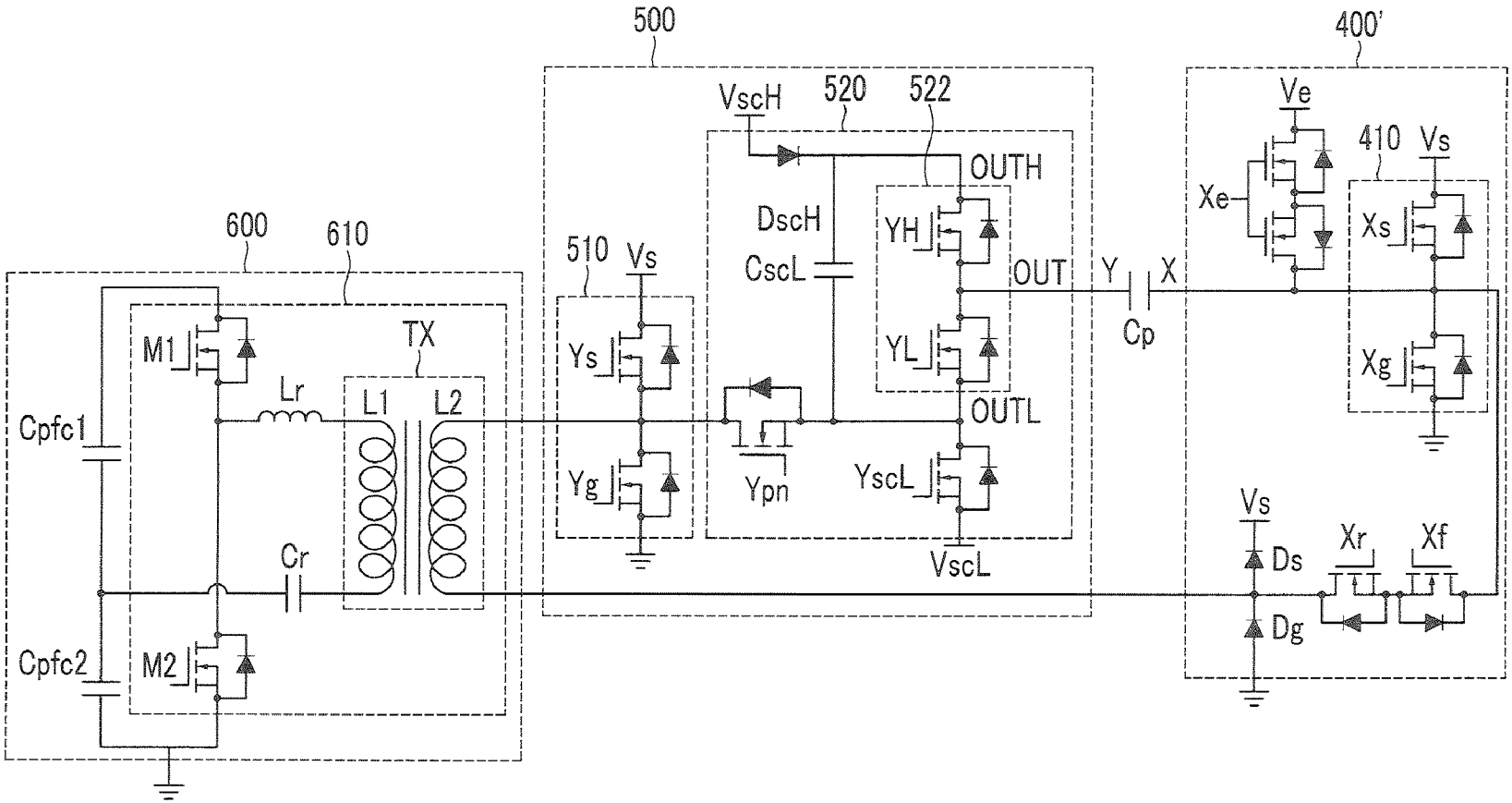
FIG. 7 is a diagram schematically showing a driving circuit constructed as a second exemplary embodiment of the present invention.

FIG. 7 is a diagram schematically showing a driving circuit constructed as a second exemplary embodiment of the present invention.

Referring to FIG. 7, a driving circuit of a sustain electrode driver 400' may further include diodes Ds and Dg and transistors Xr and Xf.

In detail, the anode of the diode Ds is connected to the other terminal of the secondary coil L2 of the transformer TX and the cathode of the diode Ds is connected to the power supply Vs. The cathode of the diode Dg is connected to the other terminal of the secondary coil L2 of the transformer TX and the anode of the diode Dg is connected to the ground terminal.

In addition, the transistor Xr and Xf are connected between the other terminal of the secondary coil L2 of the transformer TX and the X electrode in series. In this case, two transistors Xe1 and Xe2 are connected to each other in a back-to-back type that sources thereof are connected to each other or drains thereof are connected to each other.

Hereinafter, the operation of the driving circuit according to the second exemplary embodiment of the present invention will be described in detail.

Figure 8:
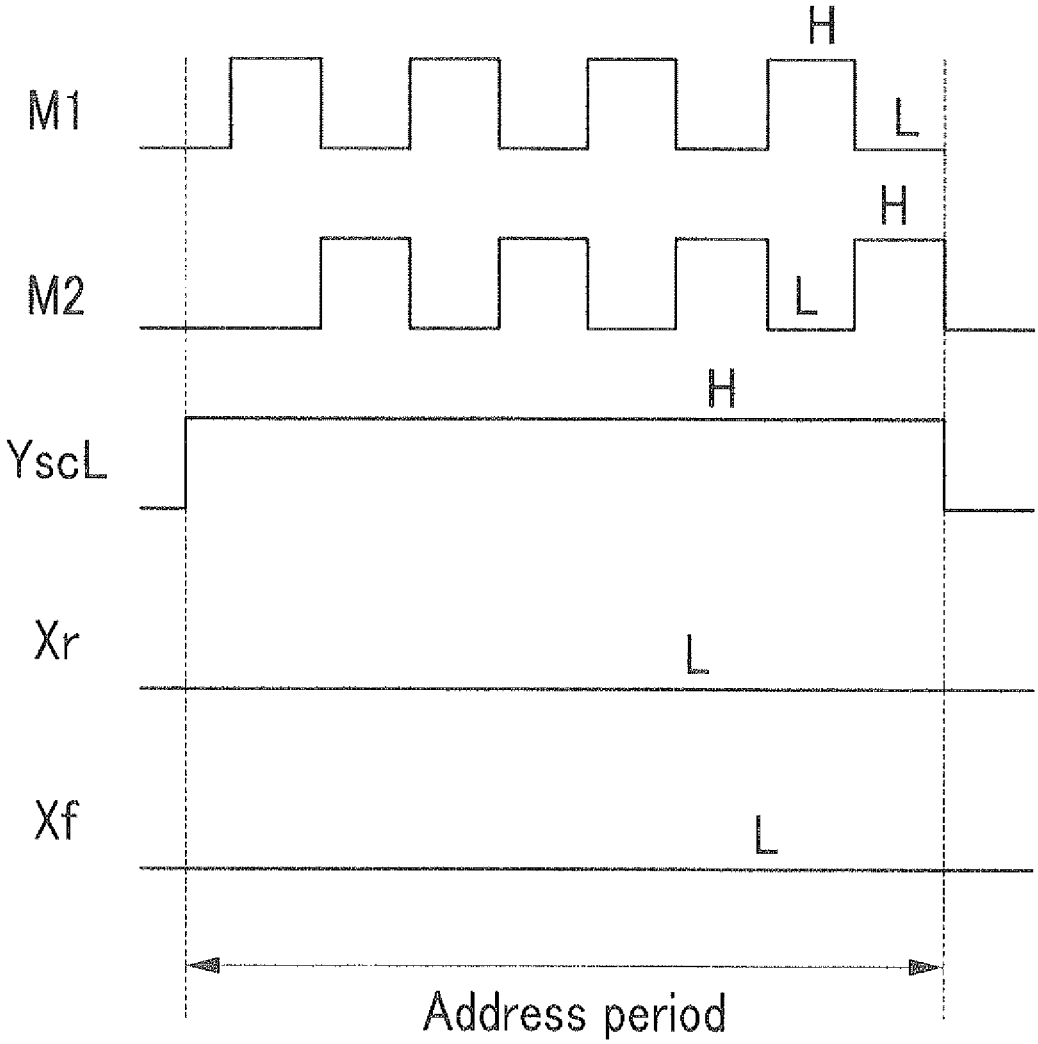
FIG. 8 is a signal timing diagram of the driving circuit shown in FIG. 7.
Figure 9:
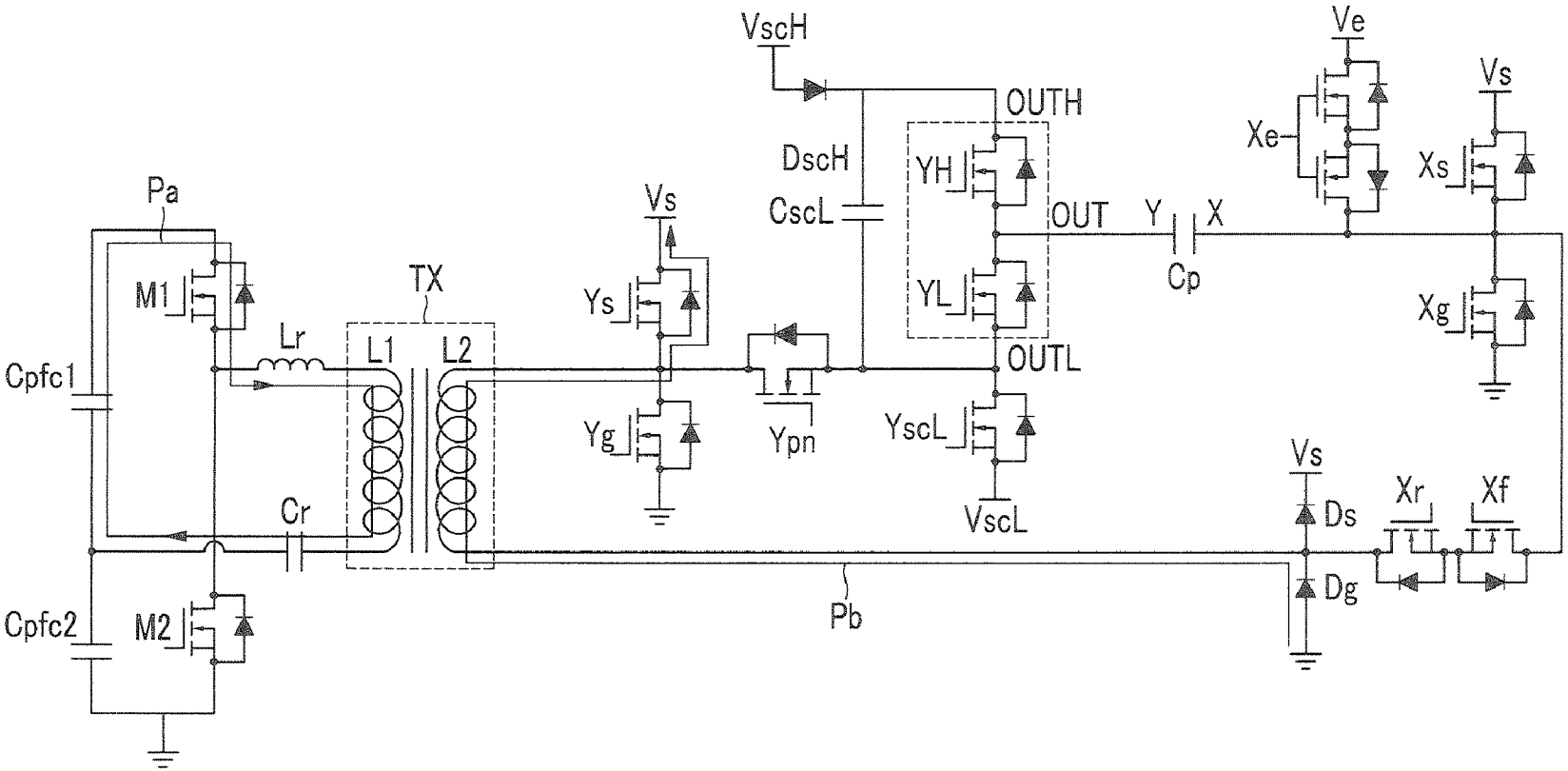
FIGS. 9 and 10 are diagrams showing a current path according to the signal timing shown in FIG. 8.
Figure 10:
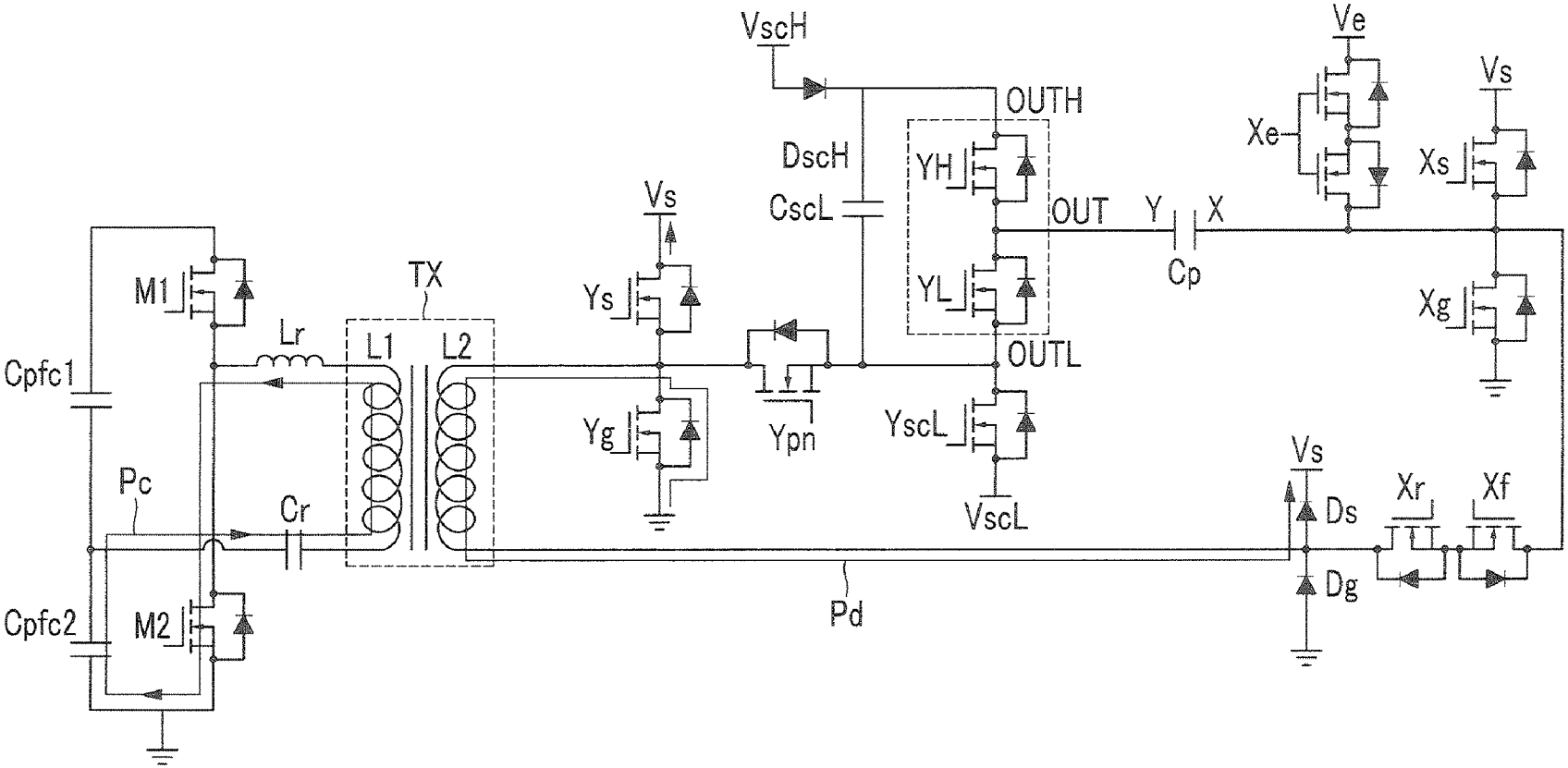

FIG. 8 is a signal timing diagram of the driving circuit shown in FIG. 7 and FIGS. 9 and 10 are diagrams showing the current path according to the signal timing shown in FIG. 8.

FIG. 8 shows the voltage of the control signal applied to the gates of the transistors M1, M2, YscL, Xr, and Xf in the address period and when the voltage of the control signal is in a high level, the transistors M1, M2, YscL, Xr, and Xf are turned-on and when the voltage of the control signal is in a low level, the transistors M1, M2, YscL, Xr, and Xf are turned-off.

Referring to FIG. 8, in the state where the transistor YscL is turned-on in the address period, the transistors YL of a plurality of scan circuits 522 are sequentially turn-on, such that the VscL voltage is sequentially applied to the plurality of Y electrodes and the scan circuit 522 in which the transistor YL is not turned-on applies the VscH to the Y electrode to which the VscL voltage is not applied by turning-on the transistor YH.

The transistors Xr and Xf are turned-off and the transistors M1 and M2 are alternately turned-on and off, for the address period.

When the transistor M1 is turned-on and the transistor M2 is turned-off, current flows through a current path Pa shown in FIG. 9 and the current path Pb shown in FIG. 9 may be formed while the current is induced to the secondary coil L2 of the transformer TX. That is, when the transistor M1 is turned-on in the state where the transistor Xr and Xf is turned-off, power Vs is supplied from the power supply Vs through the ground terminal, the diode, the secondary coil L2, the body diode of the transistor Ys, and the current path of the power supply Vs.

In addition, when the transistor M1 is turned-off and the transistor M2 is turned-on, current flows through the current path Pc shown in FIG. 10 and the current path Pd shown in FIG. 10 may be formed while the current is induced to the secondary coil L2 of the transformer TX. That is, when the transistor M2 is turned-on in the state where the transistors Xr and Xf are turned-off, power is supplied to the power supply Vs through the current path to the ground terminal, the body diode of the transistor Yg, the secondary coil L2, the diode Ds, and the power supply Vs.

As described above, the driving circuit according to the second exemplary embodiment of the present invention supplies the power to the power Vs while applying the scan pulse to the Y electrode for the address period. Since the address period occupies a half or more in one subfield, the driving circuit according to the second exemplary embodiment of the present invention may supply sufficient power to the power supply Vs while applying the scan address to the Y electrode for the address period. Therefore, the Vs voltage may be stably applied to the Y electrode even in the subfield in which the number of sustain discharge pulses is small and the screen load rate is large.

In addition, in the panel capacitor Cp, in order to interrupt the current flowing into the secondary coil L2 of the transformer TX, one of the transistors Xr and Xf is turned-off. That is, one of the transistors Xr and Xf may be turned-off in at least a part of the reset period or the sustain period. In this case, some period may include a period at which the Vs voltage is applied to the Y electrode for the predetermined time or more. In addition, some period may include a period at which Vs voltage or Ve voltage is applied to the X electrode for a setting period or more. Herein, the predetermined time may be variably set according to factors of the transformer TX contributing to the saturation of the transformer TX, for example, according to capacitance.

The above-mentioned exemplary embodiments of the present invention are not embodied only by an apparatus and/or method. Alternatively, the above-mentioned exemplary embodiments may be embodied by a program performing functions, which correspond to the configuration of the exemplary embodiments of the present invention, or a recording medium on which the program is recorded. These embodiments can be easily devised from the description of the above-mentioned exemplary embodiments by those skilled in the art to which the present invention pertains.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device, comprising:

a panel capacitor formed by a first electrode and a second electrode, and the panel capacitor performing sustain discharge;

a first transistor connected between a first power supply supplying first voltage and the first electrode;

a second transistor connected between a second power supply supplying second voltage lower than the first voltage and the first electrode, a third transistor connected between the first power supply and the second electrode;

a fourth transistor connected between the second power supply and the second electrode;

a transformer comprising a primary coil whose first terminal is connected to an input power supply and second terminal is connected to a ground terminal and a secondary coil whose first terminal is connected to the first electrode and second terminal is connected to the second electrode;

a first diode connected between the second terminal of the secondary coil and the first power supply; and a second diode connected between the second terminal of the secondary coil and the second power supply.

2. The plasma display device of claim 1, wherein:

the anode of the first diode is connected to the second terminal of the secondary coil and the cathode thereof is connected to the first power supply, and the cathode of the second diode is connected to the second terminal of the secondary coil and the anode thereof is connected to the first power supply.

3. The plasma display device of claim 1, further comprising:

a fifth and sixth transistor connected between the second terminal of the secondary coil and the second electrode in series.

4. The plasma display device of claim 3, wherein:

the fifth and the sixth transistors are connected to a back-to-back type.

5. The plasma display device of claim 3, wherein:

at least one of the fifth and the sixth transistors is turned-off in at least a part of a reset period and a sustain period, and at least a part period includes a period at which the first transistor is turned-on for a predetermined time or more.

6. The plasma display device of claim 3, further comprising:

at least one a seventh transistor operated so that voltage across the primary coil is a square wave voltage from the input power supply.

7. The plasma display device of claim 6, further comprising:

an eight transistor connected between the first electrode and a third power supply supplying third voltage lower than the second voltage, wherein the eight transistor is turned-on for the address period, the third voltage is applied to the first electrode, and the fifth and the sixth transistor are turned-off for the address period and the at least one seventh transistor is repeatedly turned-on and turned-off.

8. The plasma display device of claim 1, wherein:

the voltage of the first electrode is increased by the resonance between the secondary coil and the panel capacitor before the first transistor is turned-on in the sustain period, and the voltage of the first electrode is reduced by the resonance between the secondary coil and the panel capacitor before the second transistor is turned-on in the sustain period.

9. A plasma display device, comprising:

a panel capacitor formed by a first electrode and a second electrode, and the panel capacitor performing sustain discharge;

a first driver applying a sustain discharge pulse alternately having a high level voltage and a low level voltage to the first electrode in a sustain period;

a second driver applying the sustain discharge pulse to the second electrode in an anti-phase to the sustain discharge pulse applied to the first electrode in the sustain period; and a power supply unit supplying power to the first and second drivers by using a transformer including a primary coil connected between an input power supply and a ground terminal and a secondary coil connected between the first electrode and the second electrode and at least one first transistor operated so that voltage across the primary coil becomes a square wave voltage, wherein the first and the second drivers use the resonance between the secondary coil and the panel capacitor in the sustain period in order to apply the sustain discharge pulse.

10. The plasma display device of claim 9, wherein:

the first driver applies a scan pulse to the first electrode for an address period, and the second driver comprises a first diode forming a first current path to a first power supply supplying the high level voltage through the secondary coil in the address period, and a second diode forming a second current path to a second power supply supplying the low level voltage through the secondary coil in the address period.

11. The plasma display device of claim 10, wherein:

the at least one first transistor is repeatedly turned-on and turned-off in the address period.

12. The plasma display device of claim 10, wherein:

the anode of the first diode is connected to a second terminal of the secondary coil and the cathode thereof is connected to the first power supply, and the cathode of the second diode is connected to the second terminal of the secondary coil and the anode thereof is connected to the first power supply.

13. The plasma display device of claim 10, wherein:

the first driver comprises a second transistor for transferring the scan pulse to the first electrode, and a third transistor for turning off when the second transistor is turned-on, and the second transistor is turned-on and the third transistor is turned-off in the address period.

14. The plasma display device of claim 10, wherein:

the second driver comprises fourth and fifth transistors connected between the secondary coil and the second electrode in a back-to-back type.

15. The plasma display device of claim 14, wherein:

the second driver turns-off at least one of the fourth and the fifth transistor in at least one sub-field for at least some period, and the at least some period includes a period at which a current path to a secondary coil is formed through the panel capacitor from the primary coil for a predetermined time.

16. A driving apparatus of a plasma display device including a first electrode and a second electrode performing a display operation by receiving DC power using a transformer including a primary coil and a secondary coil, comprising:

a first transistor connected between a first power supply supplying first voltage and the first electrode;

a second transistor connected between a second power supply supplying second voltage lower than the first voltage and the first electrode;

a first diode whose anode is connected to one terminal of the secondary coil and cathode is connected to the first power supply; and a second diode whose cathode is connected to the one terminal of the secondary coil and anode is connected to the second power supply, wherein the one terminal of the secondary coil is connected to the second electrode and the other terminal of the secondary coil is connected to the first electrode.

17. The apparatus of claim 16, further comprising:

third and fourth transistors connected in a back-to-back type between one terminal of the secondary coil and the second electrode.

18. The apparatus of claim 17, wherein:

the third and the fourth transistor are turned-off in the address period in which a scan pulse is applied to the first electrode, and at least one fifth transistor operated so that the voltage across the primary coil becomes a square wave voltage is alternately turned-on and turned-off in the address period.

19. The apparatus of claim 17, wherein:

the voltage of the first electrode is increased by the resonance between the secondary coil and the panel capacitor formed by the first electrode and the second electrode before the first transistor is turned-on in the sustain period, the voltage of the first electrode is reduced by the resonance in the sustain period before the second transistor is turned-on.

20. The apparatus of claim 19, wherein:

a sixth transistor connected between the first power supply supplying the first voltage and the second electrode, a seventh transistor connected between a second power supply supplying a second voltage lower than the first voltage and the second electrode, one of the third and the fourth transistors in at least some period among the sustain period is turn-off, and the at least some period includes a period at which the first and the seventh transistor is turned-on for a predetermined time or more.

* * * * *